US008342678B2

(12) United States Patent
Kawakami et al.

(10) Patent No.: US 8,342,678 B2
(45) Date of Patent: Jan. 1, 2013

(54) INKJET RECORDING METHOD AND RECORDED ARTICLE

(75) Inventors: Hiroshi Kawakami, Kanagawa (JP); Naoki Kusunoki, Kanagawa (JP); Hideki Kaimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 394 days.

(21) Appl. No.: 12/701,621

(22) Filed: Feb. 8, 2010

(65) Prior Publication Data

US 2010/0207975 A1 Aug. 19, 2010

(30) Foreign Application Priority Data

Feb. 17, 2009 (JP) ..... 2009-034609
Oct. 14, 2009 (JP) ..... 2009-237567

(51) Int. Cl.
*B41J 2/01* (2006.01)

(52) U.S. Cl. ..... 347/105; 347/101; 347/100; 428/32.1

(58) Field of Classification Search ..... 347/105, 347/101, 100, 95, 96; 428/195, 32.1
See application file for complete search history.

(56) References Cited

U.S. PATENT DOCUMENTS 4,554,181 A * 11/1985 Cousin et al. ..... 347/105
2004/0161554 A1* 8/2004 Suda et al. ..... 428/32.1
2010/0141726 A1* 6/2010 Kawakami et al. ..... 347/102

FOREIGN PATENT DOCUMENTS

JP 09-156204 A 6/1997
JP 2001-225546 A 8/2001
JP 2006-137034 A 6/2006

* cited by examiner

*Primary Examiner* — Manish S Shah
(74) *Attorney, Agent, or Firm* — SOLARIS Intellectual Property Group, PLLC

(57) ABSTRACT

An image is recorded by ejecting two or more ink compositions on a porous layer that contains inorganic microparticles and a water-soluble resin and has a porosity [%] of 50% or more with a maximum total ejection amount (mL/m$^2$) set at less than 90% of an absorption capacity (mL/m$^2$) of diethylene glycol in the porous layer. The porosity=(absorption capacity of diethylene glycol (mL/m$^2$))/(thickness of porous layer (μm))×100. The maximum total ejection amount=(maximum ejection amount of one dot (mL/m$^2$))×(total amount of ink (%)). An inkjet recording method capable of inhibiting color change from occurring to cause color irregularities when papers are stacked on an image portion within a relatively short time after recording in high-speed processing or processing of a large number of sheets, and capable of stably obtaining images recorded with desired color tone.

14 Claims, 10 Drawing Sheets

INKJET RECORDING METHOD AND RECORDED ARTICLE

CROSS-REFERENCE TO RELATED APPLICATION

This application claims priority under 35 USC 119 from Japanese Patent Application No. 2009-34609 filed on Feb. 17, 2009 and Japanese Patent Application No. 2009-237567 filed on Oct. 14, 2009, the disclosures of which are incorporated by reference herein.

BACKGROUND OF THE INVENTION

1. Field of the Invention

The present invention relates to an inkjet recording method, wherein an inkjet method is used to eject an ink to carry out recording, and a recorded article using the same.

2. Description of the Related Art

As an image recording method for recording color images, various methods have been proposed in recent years. In all of these methods, qualities of recorded articles such as image quality, tone and reduced curling after recording are highly required.

For example, an inkjet recording method using an inkjet recording medium, which has an ink-receiving recording layer formed to have a porous structure has been practically used. As an example thereof, an inkjet recording medium, wherein a recording layer containing inorganic pigment particles and a water-soluble binder and having high porosity is disposed on a support, has been disclosed. The inkjet recording medium, owing to the porous structure, is excellent in quick-drying property of the ink and has high glossiness, thereby being capable of recording a photograph-like image.

Inkjet recording technology has been applied in the field of office printers and home printers. Recently, e inkjet recording technology is being applied to the commercial printing field, and a system capable of printing many sheets at a high speed or at one time by the inkjet system in a mini-laboratory or the like has been in demand. In general, sheets of recorded articles that are recorded at a high speed are stacked immediately after recording. Even in such cases, it is demanded as it has been in the past that not only images having excellent image quality and high glossiness are recorded at a high speed, but also density and tone of recorded images are stable from the viewpoint of recording material quality.

However, in the case of printing at a high speed or printing of a large number of sheets, it may be difficult to ignore the influence of a humidity environment or drying conditions after recording on image quality. For example, a color difference is generated between stacked portions and non-stacked portions of recorded articles that are stacked as sheets, whereby color tones become different between images or within an image, resulting in stack irregularities in some cases.

As a technology relating to such situations, for example, a method for producing inkjet recorded articles, which includes a step of hydrogelling by containing a hydrophilic resin that forms hydrogel under irradiation with actinic energy rays is disclosed in Japanese Patent Application Laid-Open (JP-A) No. 2006-137034. An inkjet recording medium having an ink-receiving layer that contains a polymer containing a vinyl compound having a nitrogen-containing cyclic group as a polymerization component is disclosed in JP-A No. 2001-225546. Furthermore, an inkjet recording method where a pore volume per unit area of an ink-receiving layer is regulated to 50% to 150% of the maximum ink ejection amount per unit area of one color is disclosed in JP-A No. 09-156204. It is considered in these disclosures that even when printed articles are stacked after printing, images hardly blur or undergo color change, and also that image deterioration phenomena such as color tone variation during ink drying may be inhibited from occurring.

SUMMARY OF THE INVENTION

The present invention has been made in view of the above circumstances and provides an inkjet recording method for recording an image and a recorded article with the following aspects.

A first aspect of the invention provides an inkjet recording method for recording an image, comprising:

ejecting at least two ink compositions on an inkjet recording medium having a support and an ink-receiving layer on the support; and providing the ink-receiving layer having a porous layer that contains inorganic microparticles and a water-soluble resin;

wherein the porous layer has a porosity of at least 50%, the porosity determined by the following Equation (1):

$$\text{porosity}=\text{absorption capacity}/\text{thickness of porous layer}\times 100, \quad \text{Equation (1)}$$

wherein the absorption capacity is measured in $mL/m^2$ of diethylene glycol absorbed by the porous layer, and the thickness is measured in μm;

wherein a maximum total ejection amount of the at least two ink compositions ($mL/m^2$) is less than 90% of the absorption capacity ($mL/m^2$) of diethylene glycol, the maximum total ejection amount determined by the following Equation (2):

$$\text{maximum total ejection amount}=\text{maximum ejection amount of one dot}(mL/m^2)\times\text{total ejection amount of ink}(\%); \quad \text{Equation (2)}$$

wherein the total ejection amount of ink represents a total of actual ejection amounts (%) of the respective at least two ink compositions relative to a total of preset ejection amounts of the respective at least two ink compositions.

A second aspect of the invention provides a recorded article comprising:

an inkjet recording medium having a support and an ink-receiving layer on the support, providing the ink-receiving layer having a porous layer that contains inorganic microparticles and a water-soluble resin;

wherein the porous layer has a porosity of at least 50%, the porosity determined by the following Equation (1); and wherein an image is recorded by ejecting at least two ink compositions on the inkjet recording medium with a maximum total ejection amount ($mL/m^2$) represented by the following Equation (2) set at less than 90% of an absorption capacity ($mL/m^2$) of diethylene glycol in the porous layer:

$$\text{porosity}=\text{absorption capacity}/\text{thickness of porous layer}\times 100, \quad \text{Equation (1)}$$

wherein the absorption capacity is measured in $mL/m^2$ of diethylene glycol absorbed by the porous layer, and the thickness is measured in μm;

$$\text{maximum total ejection amount}=\text{maximum ejection amount of one dot}(mL/m^2)\times\text{total ejection amount of ink}(\%), \quad \text{Equation (2)}$$

wherein the total ejection amount of ink represents a total of actual ejection amounts (%) of the respective at least two ink compositions relative to a total of preset ejection amounts of the respective at least two ink compositions.

DETAILED DESCRIPTION OF THE INVENTION

Figure 1:
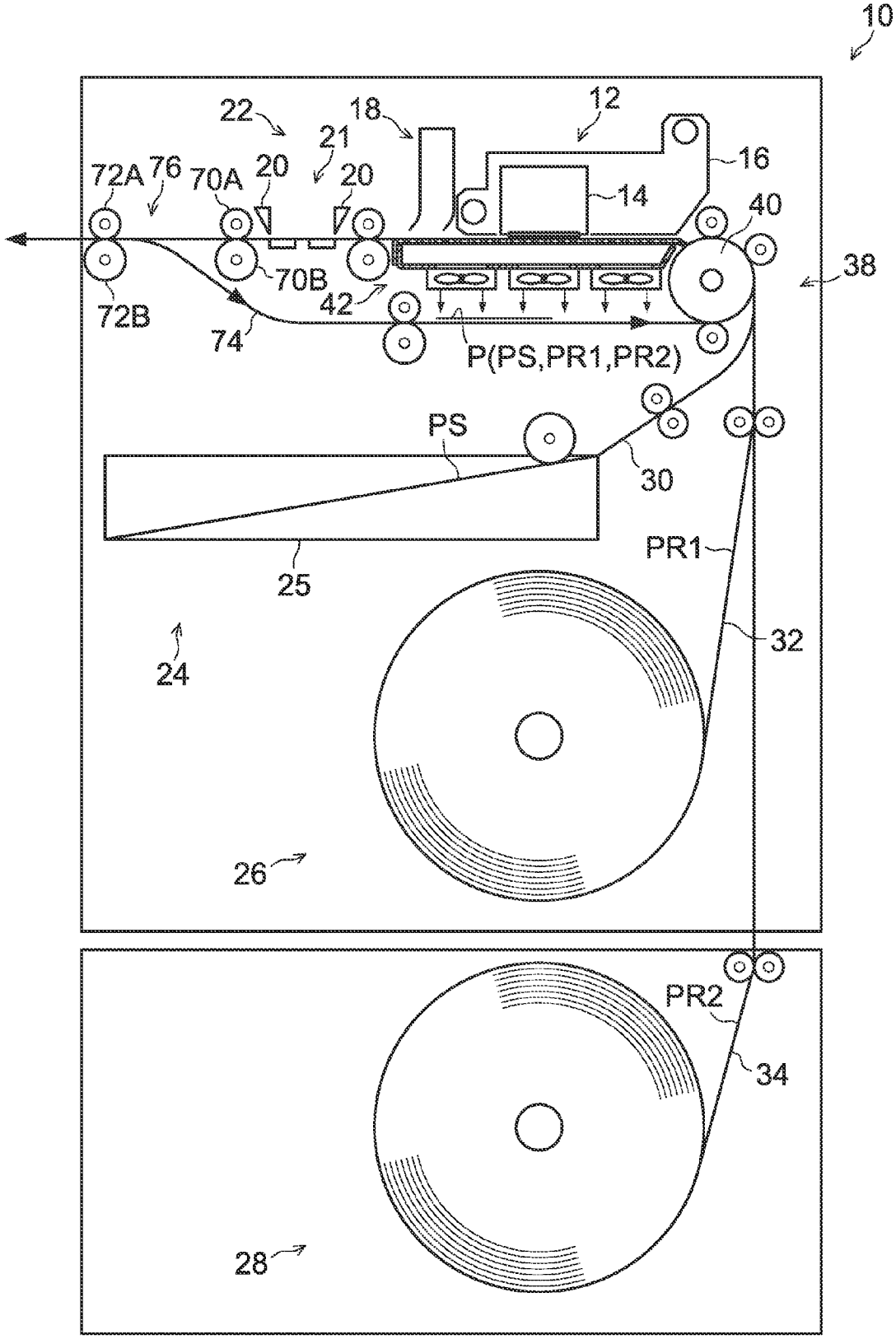
FIG. 1 is a side view showing an example of a configuration of an image forming apparatus.

In spite of the circumstances described above, in an inkjet recording medium having an ink-receiving layer formed to have a porous structure by containing inorganic microparticles, owing to droplet impact of an ink, pore diameters of the porous structure tend to become smaller, and drying tends to be more difficult. Accordingly, in a recording system recovering in a relatively short time from the completion of recording such as high-speed processing or processing of a large number of sheets, drying after recording is not necessarily sufficient in some cases. That is, even with the inkjet recording methods described above, in the case of recovering so as to stack images on each other after recording, a color difference (color change) generated between a portion where papers are stacked and a portion where papers are not stacked in an image portion still may not be avoided.

The present invention has been carried out in view of the above-mentioned situation, and intends to provide an inkjet recording method and a recorded article capable of inhibiting color change from occurring to cause color irregularities when papers or the like are stacked on an image portion within a relatively short time after recording in the case of, for example, high-speed processing or processing of a large number of sheets, and capable of stably obtaining images recorded with desired color tone.

The objects of the invention described above have been solved by the following means.

An inkjet recording method for recording an image, comprises ejecting at least two ink compositions on an inkjet recording medium having a support and an ink-receiving layer on the support; and providing the ink-receiving layer having a porous layer that contains inorganic microparticles and a water-soluble resin, wherein the porous layer has a porosity of at least 50%, the porosity determined by the following Equation (1), and a maximum total ejection amount of the at least two ink compositions ($mL/m^2$) is less than 90% of the absorption capacity ($mL/m^2$) of diethylene glycol, the maximum total ejection amount determined by the following Equation (2).

$$\text{porosity}=\text{absorption capacity}/\text{thickness of porous layer}\times 100 \qquad \text{Equation (1)}$$

In Equation (1), the absorption capacity is measured in $mL/m^2$ of diethylene glycol absorbed by the porous layer, and the thickness is measured in μm.

$$\text{maximum total ejection amount}=\text{maximum ejection amount of one dot}(mL/m^2)\times\text{total ejection amount of ink}(\%) \qquad \text{Equation (2)}$$

In Equation (2), the total ejection amount of ink represents a total of actual ejection amounts (%) of the respective at least two ink compositions relative to a total of preset ejection amounts of the respective at least two ink compositions.

Preferably, the absorption capacity is at least 20 $mL/m^2$.

Preferably, the inorganic microparticles comprise microparticles of a vapor-phase process silica, wherein a content of the vapor-phase process silica in the porous layer is 60% by weight or more, and wherein a ratio of the vapor-phase process silica (p) to the water-soluble resin (b) (PB ratio by weight ratio; p/b) is within a range of from 3 to 7.

Preferably, the ink composition is ejected at an ink droplet impact density of 1200 dpi or more.

Preferably, the inorganic microparticles are microparticles of a vapor-phase process silica, a content of the vapor-phase process silica in the porous layer is 60% by weight or more, and a content ratio of the vapor-phase process silica (p) to the water-soluble resin (b) (PB ratio by weight ratio; p/b) is from 3 to 7.

Preferably, the inkjet recording medium is wound in a roll, and the inkjet recording medium is cut within 10 seconds after ejection of the ink compositions.

Preferably, the porous layer further includes a mordant, and the mordant includes at least one compound selected from a group consisting of a water-soluble aluminum compound, a water-soluble zirconium compound and a cationic polyurethane.

A recorded article comprises an inkjet recording medium having a support and an ink-receiving layer on the support, providing the ink-receiving layer having a porous layer that contains inorganic microparticles and a water-soluble resin, wherein the porous layer has a porosity of at least 50%, the porosity determined by the following Equation (1), and an image is recorded by ejecting at least two ink compositions on the inkjet recording medium with a maximum total ejection amount ($mL/m^2$) represented by the following Equation (2) set at less than 90% of an absorption capacity ($mL/m^2$) of diethylene glycol in the porous layer.

$$\text{porosity}=\text{absorption capacity}/\text{thickness of porous layer}\times 100 \qquad \text{Equation (1)}$$

In Equation (1), the absorption capacity is measured in $mL/m^2$ of diethylene glycol absorbed by the porous layer, and the thickness is measured in μm.

$$\text{maximum total ejection amount}=\text{maximum ejection amount of one dot}(mL/m^2)\times\text{total ejection amount of ink}(\%) \qquad \text{Equation (2)}$$

In Equation (2), the total ejection amount of ink represents a total of actual ejection amounts (%) of the respective at least two ink compositions relative to a total of preset ejection amounts of the respective at least two ink compositions.

According to the present invention, an inkjet recording method and a recorded article are provided, which are capable of inhibiting color change from occurring to cause color irregularities when papers or the like are stacked on an image portion within a relatively short time after recording in the case of, for example, high-speed processing or processing of a large number of sheets, and capable of stably obtaining images recorded with desired color tone.

Hereinafter, an inkjet recording method of the present invention will be described in more detail.

An inkjet recording method of the invention is configured in such a manner that an image is recorded by ejecting two or more ink compositions (hereinafter, also simply referred to as "ink") onto an inkjet recording medium having, as an ink-receiving layer, a porous layer that contains inorganic microparticles and a water-soluble resin and has a porosity represented by the following Equation (1) of 50% or more on a support, with the maximum total ejection amount ($mL/m^2$) represented by the following Equation (2) set at less than 90% of an absorption capacity (DEG absorption capacity; ($mL/m^2$) of diethylene glycol (hereinafter, abbreviated as "DEG" in some cases) in the porous layer.

$$\text{Porosity}(\%)=(\text{DEG absorption capacity}(mL/m^2))/(\text{thickness of porous layer}(\mu m))\times 100 \quad \text{Equation (1)}$$

$$\text{Maximum total ejection amount}(mL/m^2)=(\text{Maximum ejection amount of one dot}(mL/m^2))\times(\text{total amount of ink }[\%]) \quad \text{Equation (2)}$$

The DEG absorption capacity of the porous layer is a value obtained in such a manner that, onto a surface of a porous layer of a test piece obtained by cutting an inkjet recording medium disposed with a porous layer into a 10 cm square piece, 1 mL of diethylene glycol is added dropwise, followed by wiping off an excess amount thereof after 30 sec, further followed by obtaining a weight difference before and after the dropwise addition, from which the value is obtained.

The maximum total ejection amount means "a theoretical maximum total ejection amount in an LUT (Look Up Table) design", and is a maximum amount of a total of ejection amounts of the respective inks per unit area in an apparatus being used.

Furthermore, the total ejection amount of ink (%) represents a total (a %) of actual ejection amounts of the respective inks relative to the respective preset ejection amounts (A %) of plural inks (for example: Y (yellow), M (magenta), C (cyan) and K (black)). In the case where the respective preset ejection amounts (A %) of four colors of YMCK in an apparatus are, for example, 100% (a preset value of the four colors is 400% at maximum), when actual ejection amounts (a %) when, for example, a gray image is recorded are, for example, Y=M=C=K=30%, a total amount of ink is 120%. The maximum total ejection amount at this time, with the maximum ejection amount of one dot set at, for example, 20 $mL/m^2$, is $20\times1.2=24$ $mL/m^2$.

However, when, for example, a localized excessive ejection such as described below is applied as image processing, the maximum total ejection amount does not apply.

Figure 10:
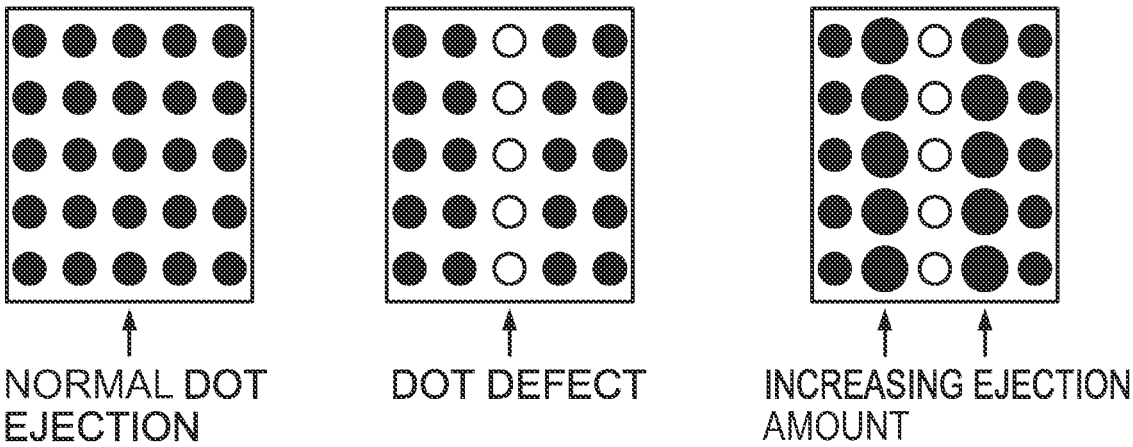
FIG. 10 is a diagram for explaining an embodiment where a droplet ejection amount is locally increased.
Figure 11:
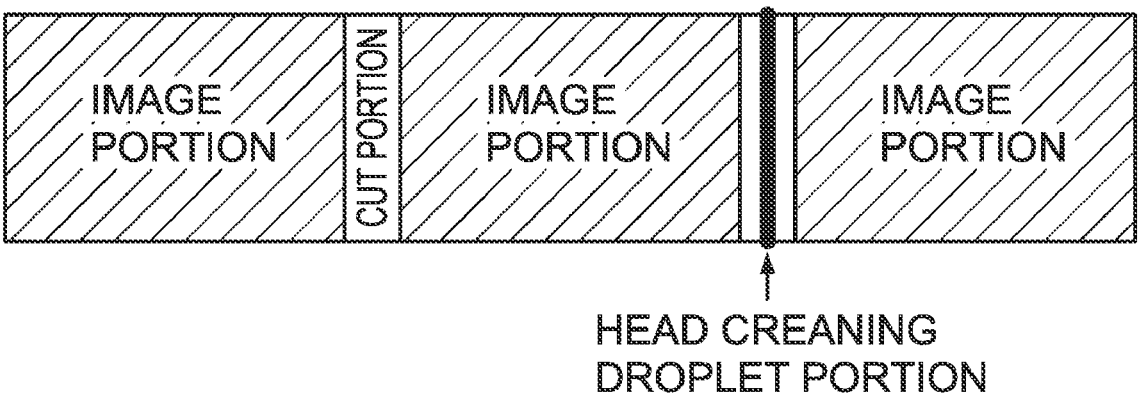
FIG. 11 is a diagram for explaining an embodiment of performing maintenance at a cutting and disposal portion.

1) A case where an ink droplet ejection amount is locally adjusted such as a case where adjacent droplet impact failures are corrected (for example, ink droplet ejection amounts of adjacent dots are increased to compensate for image defects with respect to head non-ejection portions such as shown in, for example, FIG. 10).
2) A case where a head is cleaned such as a case where a maintenance operation is applied to a non-image portion (a cutting and disposal portion such as a cutting portion shown in FIG. 11).

In the invention, when an image is recorded with the maximum total ejection amount of ink ejected suppressed to less than 90% of the DEG absorption capacity in a porous layer having the porosity of 50% or more, while alleviating drying load, even when inkjet recording media are stacked on a recorded surface and recovered within a relatively short time after high-speed recording, a color change (color difference) between a stacked image portion and a non-stacked image portion may be inhibited. Thereby, color difference between images or in an image (hereinafter, referred to as stack irregularities) may be inhibited from occurring. As a result, a stable color reproduction is realized and thereby an image having stable color tone with desired hue may be obtained.

There is no particular limitation on the recording method, and any known inkjet recording system may be used. For example, a charge control system of ejecting ink using electrostatic attractive force; a drop-on-demand system (pressure pulse system) of using the oscillating pressure of a piezoelectric element; an acoustic inkjet system of converting electric signals to an acoustic beam, propagating the acoustic beam to the ink, and ejecting the ink using the radiation pressure; a thermal inkjet system (Bubble-Jet; trade name) of forming air bubbles by heating the ink, and using the pressure generated therefrom; and the like may be used. For example, as disclosed in JP-A No. 54-59936, an inkjet recording method wherein ink is ejected from nozzle by action force owing to drastic volume change of ink given by thermal energy may be used.

An inkjet head may be either an on-demand system or a continuous system. Specific examples of ejection methods include an electric-mechanical transduction method (for example, a single-cavity type, a double-cavity type, a bender type, a piston type, a shear mode type, a shared wall type or the like), an electric-thermal transduction method (for example, a thermal inkjet type, a bubble-jet method (registered trademark) or the like), an electrostatic suction method (for example, an electric field control type, a slit jet type or the like) and a discharge method (for example, a spark jet type or the like). Any of the ejection methods may be used. As the inkjet head, in addition to a shuttle method where a short serial head is scanned in a widthwise direction of a recording medium to record, a line method where a line head having recording elements two-dimensionally arranged corresponding to a gamut of one side of the recording medium may be applied. In the line method, the recording medium is scanned in a direction orthogonal to an arrangement direction of the recording elements to record an image over an entire surface of the recording medium. Furthermore, since only the recording medium moves, higher speed recording compared with the shuttle method may be realized.

An amount of ink droplets ejected from the inkjet head is preferably 0.2 pL to 10 pL (picolitter) and more preferably 0.4 pL to 5 pL from the viewpoint of large alleviation effect of drying load and effective suppression of color change of an image.

An ink may be ejected from an inkjet head at a dot density of from 600 dpi to 720 dpi that has been generally used (for example, by use of FRONTIER DRY MINILAB DL410 (with a 720 dpi shuttle method head mounted) (trade name, manufactured by FUJI FILM CORPORATION)). However, a method where an ink is ejected at a dot density of 1200 dpi or more is preferably used. In this case, by use of a line method that uses a line head where recording elements are two-dimensionally arranged, an ink may be preferably ejected at the ink droplet impact density of 1200 dpi or more, and thereby an image having high resolution is recorded at a high speed with a slight amount of ink.

<Porous Layer>

In an inkjet recording method of the present invention, an inkjet recording medium that includes a support and a porous layer as an ink-receiving layer disposed on the support and containing inorganic microparticles and a water-soluble resin is used. The porous layer in the invention is a layer (ink-receiving layer) that receives an ink ejected externally and is constituted with at least inorganic microparticles and a water-soluble resin. Furthermore, the ink-receiving layer may be constituted, as required, by further containing a mordant, a crosslinking agent for crosslinking the water-soluble resin and other additives, and may be constituted into a multilayer structure having two or more layers.

The porous layer contains at least inorganic microparticles. By containing the inorganic microparticles, a porous layer is formed to have a porous structure, and thereby ink absorptivity is increased. In the invention, the porosity of the porous layer is particularly set at 50% or more.

When the porosity of the porous layer containing inorganic microparticles and a water-soluble resin is less than 50%, an ink absorbing property itself of a surface of the porous layer is too low; accordingly, blurring or unsharpness tends to occur in an image and drying load becomes large to cause color change easily. Furthermore, when priority is given to image quality, an amount of liquid droplets has to be reduced, resulting in incapability of maintaining image density.

In the porous layer in the invention, the DEG absorption capacity on a surface of the porous layer is preferably set to 20 $mL/m^2$ or less. When the DEG absorption capacity is within the range, paper deformation such as curling accompanying recording is inhibited from occurring, and color mixing or blurring between colors during image recording is suppressed. In particular, the DEG absorption capacity is preferably from 10 $mL/m^2$ to 19 $mL/m^2$ and more preferably from 12 $mL/m^2$ to 18 $mL/m^2$. In this case, the porosity is preferably 50% or more. When the porosity is less than 50%, even when the DEG absorption capacity is 20 $mL/m^2$ or less, paper deformation and color mixing/blurring between colors may not be suppressed.

At recording, the maximum total ejection amount of an ink is set at less than 90% of the DEG absorption capacity. Herein, the reason why the absorption capacity of diethylene glycol (DEG) is used is to assume absorption amount of a solvent in an ink to be applied. When the maximum total ejection amount of an ink ejected during image recording is 90% or more of the DEG absorption capacity, the absorption capacity may not be maintained and drying load is large and color change of an image may not be suppressed. The maximum total ejection amount to the DEG absorption capacity is preferably less than 85% and more preferably less than 80%. In this process, a lower limit value is desirably 50%.

In this case, the maximum total ejection amount of an ink is preferably from 8 $mL/m^2$ to 18 $mL/m^2$ and more preferably from 10 $mL/m^2$ to 16 $mL/m^2$ from the viewpoint of large alleviation effect of the drying load and effective suppression of color change of an image.

The maximum total ejection amount of an ink in the invention is an amount necessary for recording an image. That is, the invention does not include, for example, an embodiment containing only a case shown below, but may include an embodiment containing a case shown below while recording an image at the maximum total ejection amount of an ink in the invention.

1) A case where an ink droplet ejection amount is controlled by image correction such as a case where an ink droplet ejection amount is locally increased to correct abutting droplets impact failure (for example, a case where an image defect is corrected by increasing an ink droplet ejection amount of a dot abutting to a head non-ejection portion), and
2) a case where an ink is ejected at a large ink droplet ejection amount by head cleaning such as a case where an ink is ejected at a large ink droplet ejection amount to a cut and disposal portion to apply maintenance.

In the invention, preferably, the porosity of a porous layer is 50% or more and the maximum total ejection amount is from 55% to 90% with respect to the DEG absorption capacity, more preferably, the porosity of a porous layer is 60% or more and the maximum total ejection amount is from 60% to 85% with respect to the DEG absorption capacity, and particularly preferably, the porosity of a porous layer is 65% or more and the maximum total ejection amount is from 65% to 85% with respect to the DEG absorption capacity, from the viewpoint of effectively inhibiting a color from changing in the case where a medium recorded at a high speed while alleviating the drying load is stacked on a recorded surface in a relatively short time after recording.

<Inorganic Microparticles>

Examples of the inorganic microparticles include silica microparticles, colloidal silica, titanium dioxide, barium sulfate, calcium silicate, zeolite, kaolinite, halloysite, mica, talc, calcium carbonate, magnesium carbonate, calcium sulfate, pseudo boehmite, zinc oxide, zinc hydroxide, alumina, aluminum silicate, calcium silicate, magnesium silicate, zirconium oxide, zirconium hydroxide, cerium oxide, lanthanum oxide, and yttrium oxide. Among these, silica microparticles, colloidal silica, alumina microparticles or pseudo boehmite is preferred from the viewpoint of forming excellent porous structures. Inorganic microparticles may be used either in a state of primary particles or in a state where secondary particles are formed. An average particle diameter of inorganic microparticles is, by average primary particle diameter, preferably 2 μm or less and more preferably 200 nm or less. Furthermore, silica microparticles having an average primary particle diameter of 30 nm or less, colloidal silica having an average primary particle diameter of 30 nm or less, alumina microparticles having an average primary particle diameter of 20 nm or less, or pseudo boehmite having an average pore radius of from 2 nm to 15 nm is preferred, in particular, silica microparticles, alumina microparticles and pseudo boehmite are preferred.

In general, silica microparticles are usually roughly classified into wet process particles and dry process (gas-phase process) particles, on the basis of the production method. In the wet process, methods of obtaining hydrated silica by producing activated silica through acid decomposition of silicates, appropriately polymerizing the activated silica, and then subjecting the resultant to aggregation and sedimentation, are mainly conducted. On the other hand, in the gas phase process, methods of obtaining anhydrous silica according to a process based on high temperature gas phase hydrolysis of silicon halide (flame hydrolysis method), or a process of heating, reducing and gasifying silica sand and cokes using an arc in an electric furnace, and oxidizing the resultant with air (arc method), are mainly conducted. The "vapor-phase process silica" means synthesized silica (anhydrous silica microparticles) obtained by the gas phase process. The gas-phase process silica has differences in the density of silanol group, the presence or absence of pores, and the like, as compared with the hydrated silica, and thus exhibit different properties. However, the gas-phase process silica is suitable for forming a three-dimensional structure having high porosity. The reason for this phenomenon is not clearly understood; however, it is thought that in the case of hydrated silica, the density of silanol groups at the microparticle surface is as high as 5 to 8 groups/$nm^2$, and the silica microparticles are likely to form compact aggregates (aggregates), whereas in the case of the gas-phase process silica, the density of silanol groups at the microparticle surface is as low as 2 to 3 groups/$nm^2$, and therefore, the silica microparticles form sparse, soft aggregates (flocculates), consequently forming a structure with high porosity. The gas-phase process silica is particularly preferable as silica microparticles.

Since the silica microparticles have a particularly large specific surface area, the microparticles have high ink absorptivity and efficiency of ink retention. Furthermore, since the silica microparticles have a low refractive index, when dispersion is carried out to an extent that an appropriate particle size is obtained, the ink receiving layer may be made transparent, and there is an advantage that high color densities and satisfactory coloring properties may be obtained. As such, the fact that the ink receiving layer is transparent, is important not only for the applications wherein transparency is required, such as OHP sheets, but also in the case of applying the ink receiving layer to recording media such as photographic gloss paper, from the viewpoint of obtaining high color densities, satisfactory coloring properties and high glossiness.

An average primary particle diameter of the vapor-phase process silica is preferably 30 nm or less, more preferably 20 nm or less, even more preferably 10 nm or less, and particularly preferably from 3 nm to 10 nm. Since vapor-phase process silica easily adheres to each other by hydrogen bonding between the silanol groups, the vapor-phase process silica having the average primary particle size of 30 nm or less can form a structure having high porosity, and thus, ink absorbing characteristics may be effectively enhanced.

Furthermore, the silica microparticles may be used together with the other microparticles. When the other microparticles and the vapor-phase process silica are used in combination, the content of the vapor-phase process silica in the total microparticles is preferably 30% by weight or more and more preferably 50% by weight or more.

Preferable examples of the inorganic microparticles which may be used in combination with the silica microparticles include alumina microparticles, alumina hydrate, and mixtures or composites thereof. Among these, alumina hydrate is preferred from the viewpoint of excellently absorbing an ink to fix, pseudo boehmite ($Al_2O_3.nH_2O$) being particularly preferred. The alumina hydrate may be used in various forms and sol boehmite is preferably used as a raw material because a smooth layer is easily obtained. As to a porous structure of pseudo boehmite, an average pore radius thereof is preferably from 1 nm to 30 nm and more preferably from 2 nm to 15 nm. Furthermore, the pore volume thereof is preferably from 0.3 mL/g to 2.0 mL/g and more preferably from 0.5 mL/g to 1.5 mL/g. Herein, the pore radius and pore volume are measured according to a nitrogen adsorption/desorption method. For example, a gas adsorption/desorption analyzer (for example, trade name: OMNISORP 369, manufactured by Coulter Co., Ltd.) may be used to measure.

Furthermore, among alumina microparticles, vapor phase alumina microparticles are preferred because of large specific surface area thereof. An average primary particle diameter of the vapor phase alumina is preferably 30 nm or less and more preferably 20 nm or less.

The content of the inorganic microparticles in an ink-receiving layer is, relative to a total solid content of the ink-receiving layer, preferably from 50% to 90% by weight and more preferably from 60% to 80% by weight.

<Water-soluble Resin>

The porous layer includes at least one of water-soluble resins. Examples of the water-soluble resin include polyvinyl alcohol-based resins [polyvinyl alcohol (PVA), acetoacetyl-modified polyvinyl alcohol, cation-modified polyvinyl alcohol, anion-modified polyvinyl alcohol, silanol-modified polyvinyl alcohol and polyvinyl acetal], which are resins having hydroxyl groups as hydrophilic groups, cellulose resins [methyl cellulose (MC), ethyl cellulose (EC), hydroxyethyl cellulose (HEC), carboxymethyl cellulose (CMC), hydroxypropyl cellulose (HPC), hydroxyethyl methyl cellulose and hydroxypropyl methyl cellulose], chitins, chitosans, starches, resins having ether bonds [polypropylene oxide (PPO), polyethylene glycol (PEG) and polyvinyl ether (PVE)], and resins having carbamoyl groups [polyacrylamide (PAAM), polyvinyl pyrrolidone (PVP) and polyacrylic acid hydrazide)]. Other examples include polyacrylic acid salts, maleic acid resins, alginic acid salts and gelatins, which have carboxyl groups as dissociative groups.

Among these, as the water-soluble resin, at least one kind selected from the group consisting of polyvinyl alcohol-based resins, cellulose resins, resins having ether bonds, resins having carbamoyl groups, resins having carboxyl groups and gelatins is preferred, in particular, polyvinyl alcohol (PVA)-based resins are preferred.

Examples of the polyvinyl alcohol-based include those described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105, 11-348417, 58-181687, 10-259213, 2001-72711, 2002-103805, 2000-63427, 2002-308928, 2001-205919 and 2002-264489. Furthermore, examples of water-soluble resins other than the polyvinyl alcohol-based resins include the compounds described in paragraph [0011] to [0012] in JP-A No. 11-165461 and compounds described in JP-A Nos. 2001-205919 and 2002-264489.

The content of the water-soluble resin is preferably from 9% to 40% by weight, and more preferably from 12% to 33% by weight, with respect to the total solid content of the porous layer.

Each of the water-soluble resin and inorganic microparticles, which are main constituents of the porous layer, may be composed of a single material or a mixture of plural materials. The water-soluble resin to be used in combination with the inorganic microparticles, particularly silica microparticles, is important from the viewpoint of maintaining transparency of the layer. When vapor-phase process silica is used, as the water-soluble resin, a polyvinyl alcohol-based resin is preferably used in combination, a polyvinyl alcohol-based resin having a saponification degree of from 70% to 100% is more preferred, and a polyvinyl alcohol-based resin having a saponification degree of from 80% to 99.5% is particularly preferred.

The polyvinyl alcohol-based resin has hydroxyl groups in the structural units thereof, and the hydroxyl groups and surface silanol groups of the silica microparticles form hydrogen bonds; accordingly, a three dimensional network structure with secondary particles of the silica microparticles as network chain units is readily formed. It is thought that an ink-receiving layer having a porous structure with high porosity and sufficient strength is formed owing to the formation of the three dimensional network structure. The porous ink-receiving layer obtained as described above rapidly absorbs ink by capillary action during inkjet recording, and thereby dots free from ink blur and excellent in the circularity may be formed.

The polyvinyl alcohol-based resin may be used together with other water-soluble resins. When the polyvinyl alcohol-based resin is used together with other water-soluble resins, the content of polyvinyl alcohol-based resin in the total water-soluble resins is preferably 50% by weight or more and more preferably 70% by weight or more.

A layer structure and layer strength of the porous layer may be improved by optimizing a content ratio of inorganic microparticles (p) to a water-soluble resin (b) [p/b; PB ratio by weight ratio). The PB ratio (p/b) is preferably within a range of from 1.5 to 10. This is because when the PB ratio is too large, the film strength is lowered and cracks are caused during drying, and when the PB ratio is too small, voids tend to be clogged with the resin and the porosity is lowered to lower the ink absorbing property.

In the invention, as the inorganic microparticles, vapor-phase process silica is preferred from the viewpoint of obtaining high porosity. In this case, from the viewpoint of obtaining high porosity of 50% or more in particular, it is preferred that a content of the vapor-phase process silica in the porous layer is set at 60% by weight or more, and a content ratio of the vapor-phase process silica (p) to water-soluble resin (b) (p/b; PB ratio) is set in the range of from 3 to 7. Among these, from the same reason, it is preferred that a content of the vapor-phase process silica in the porous layer is from 60% by weight to 80% by weight, and the PB ratio of the vapor-phase process silica to water-soluble resin is within a range of from 3 to 7, and more preferred that a content of the vapor-phase process silica in the porous layer is from 60% by weight to 75% by weight, and the PB ratio of the vapor-phase process silica to water-soluble resin is within a range of from 3.5 to 6.5.

For example, when a coating solution obtained by dispersing vapor-phase process silica microparticles having an average primary particle diameter of 20 nm or less and a polyvinyl alcohol-based resin at the above p/b ratio in an aqueous solution is coated on a support and a coated film formed by coating is dried, a three-dimensional network structure having secondary particles of the silica microparticles as a network is formed as a porous layer.

<Mordant>

The porous layer in the invention preferably further includes a mordant in addition to the inorganic microparticles and water-soluble resin. Examples of the mordant include, for example, inorganic mordants such as water-soluble metal compounds and organic mordants such as cationic polymers, and water-soluble polyvalent metal salts and nitrogen-containing cationic polymers are preferably used.

Examples of the water-soluble metal compound include water-soluble salts of metals selected from, calcium, barium, manganese, copper, cobalt, nickel, aluminum, iron, zinc, zirconium, chromium, tungsten, and molybdenum. "Water-solubility" of the water-soluble metal compound means that the metal compound dissolves 1% by weight or more in water at 20° C.

Among water-soluble metal compounds, metal compounds having a valence of three or more are preferred, aluminum compounds or compounds containing metals belonging to 4A group of the periodic table (such as zirconium or titanium) are preferred, and aluminum compounds are more preferred. Water-soluble aluminum compounds are particularly preferred.

Examples of the water-soluble aluminum compounds include, aluminum chloride or hydrate thereof (for example: aluminum chloride hexahydrate), aluminum sulfate or hydrate thereof, aluminum alum, aluminum sulfite, aluminum thiosulfate, aluminum nitrate nonahydrate, aluminum acetate, aluminum lactate and basic aluminum thioglycolate. Furthermore, basic aluminum polyhydroxide compounds that are an inorganic aluminum-containing cationic polymer (hereinafter, also referred to as "basic polyaluminum chloride", "polyaluminum chloride") are known and preferably used. The basic polyaluminum hydroxide compound is a water-soluble polyaluminum hydroxide whose main component is represented by the following formula 1, formula 2 or formula 3, and which stably contains a basic, high molecular weight polynuclear condensed ion, such as $[Al_6(OH)_{15}]^{3+}$, $[Al_8(OH)_{20}]^{4+}$, $[Al_{13}(OH)_{34}]^{5+}$ or $[Al_{21}(OH)_{60}]^{3+}$.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)}[0<m<3n] \quad \text{Formula 3}$$

These are marketed from Taki Chemical Co., Ltd. under the name of polyaluminum chloride (trade name: PAC) as water treating agents; from Asada Chemical Industry Co., Ltd. under the name of polyaluminum hydroxide (trade name: PAHO); from Rikengreen Co., Ltd. under the name of HAP-25 (trade name); from Taimei Chemical Co., Ltd. under the name of ALFINE 83 (trade name); and from other makers for similar purposes, and products of various grades may be readily available.

Specific examples of the water-soluble metal compounds other than aluminum compounds include calcium acetate, calcium chloride, calcium formate, calcium sulfate, calcium butyrate, barium acetate, barium sulfate, barium phosphate, barium oxalate, barium naphthoresorcin carboxylate, barium butyrate, manganese chloride, manganese acetate, manganese formate dihydrate, ammonium manganese sulfate hexahydrate, cupric chloride, ammonium copper (II) chloride dihydrate, copper sulfate, copper (II) butyrate, copper oxalate, copper phthalate, copper citrate, copper gluconate, copper naphthenate, cobalt chloride, cobalt thiocyanate, cobalt sulfate, cobalt (II) acetate, cobalt naphthenate, nickel sulfate hexahydrate, nickel chloride hexahydrate, nickel acetate tetrahydrate, ammonium nickel sulfate hexahydrate, amide nickel sulfate tetrahydrate, nickel sulfaminate, nickel 2-ethylhexanoate, ferrous bromide, ferrous chloride, ferric chloride, ferric sulfate, ferrous sulfate, iron (III) citrate, iron (III) lactate trihydrate, triammonium iron (III) trioxalate trihydrate, zinc bromide, zinc chloride, zinc nitrate hexahydrate, zinc sulfate, zinc acetate, zinc lactate, chromium acetate, chromium sulfate, sodium tungstophosphate, tungsten sodium citrate, dodecatungstophosphate n-hydrate, dodecatungstosilicate hexacosahydrate, molybdenum chloride, dodecamolybdophosphate n-hydrate, zinc phenolsulfonate, ammonium zinc acetate, and ammonium zinc carbonate.

As the compound containing a metal belonging to Group 4A of the Periodic Table, water-soluble compounds containing titanium or zirconium are more preferable. Examples of a water-soluble metal compound containing titanium include titanium chloride, titanium sulfate, titanium tetrachloride, tetraisopropyl titanate, titanium acetylacetonate, and titanium lactate. Examples of a water-soluble metal compound containing zirconium include zirconium acetate, zirconyl acetate, zirconium chloride, zirconium hydroxychloride, zirconium nitrate, zirconyl nitrate, basic zirconium carbonate, zirconium hydroxide, zirconium lactate, zirconyl lactate, ammonium zirconium carbonate, potassium zirconium carbonate, ammonium zirconyl carbonate, potassium zirconyl carbonate, zirconium sulfate, zirconium fluoride, zirconyl sulfate and zirconyl fluoride.

The content of the water-soluble metal compound (preferably a water-soluble aluminum compound) in the porous layer is preferably from 0.1% to 10% by weight and more preferably from 0.5% to 8% by weight with respect to the inorganic microparticles from the viewpoint of print density and water resistance.

Furthermore, as the mordant, cationic polymers as well are preferred, for example, nitrogen-containing organic cationic polymers are preferred, polymers having primary to tertiary amino groups or quaternary ammonium salt groups are preferred. Examples of the nitrogen-containing organic cationic polymer include nitrogen-containing organic cationic polymers that are homopolymers of a monomer (nitrogen-containing cationic monomer) having a primary to tertiary amino group, a salt thereof or a quaternary ammonium salt group, nitrogen-containing organic cationic polymers obtained as a copolymer or polycondensation product between the nitrogen-containing organic cationic polymer and other monomer, and nitrogen-containing organic cationic polymers obtained by modifying by cationizing urethane polymers having urethane bonds with a compound containing a cationic group.

Among these, cationic polyurethanes, and cationic polyacrylates described in JP-A No. 2004-167784 are preferred, and cationic polyurethanes are more preferred from the viewpoint of inhibition of blurring. Examples of commercially available cationic polyurethane include "SUPERFLEX 650", "F-8564D", and "F-8570D" (trade name, manufactured by DAI-ICHI KOGYO SEIYAKU Co., Ltd.), and "NEOFIX IJ-150" (trade name, manufactured by NICCA CHEMICAL Co., Ltd.).

In the invention, the mordant is preferably a water-soluble aluminum compound, a water-soluble zirconium compound or a cationic polyurethane from the viewpoints of print density and water resistance.

The porous layer of the invention, as required, may include other additives such as various UV-absorbents, surfactants, antioxidants, or anti-fading agents such as singlet oxygen quenchers. The additives are detailed in paragraphs [0081] to [0090] of JP-A No. 2007-98657.

<Support>

An inkjet recording medium in the invention is constituted by disposing a support.

As the support, both of a transparent support made of a transparent material such as plastics and a non-transparent support made of a non-transparent material such as paper may be used. From the viewpoint of making use of the transparency of the porous layer, the transparent support or a non-transparent support with high glossiness is preferred. The supports in the invention are detailed in paragraphs [0140] to [0155] of JP-A No. 2008-246988 and preferable embodiments as well are detailed therein.

A layer thickness of the porous layer is preferably determined in association with the porosity in the layer from the viewpoint of obtaining absorption capacity capable of absorbing all liquid droplets. When, for example, an amount of an ink is 8 nL/mm$^2$ and the porosity is 60%, a film having a layer thickness of substantially 15 μm or more is necessary. When this is taken into consideration, the film thickness of the porous layer is preferably 10 μm to 50 μm, more preferably 20 μm to 40 μm and still more preferably 20 μm to 30 μm.

A pore diameter of the porous layer is, by median diameter, preferably 0.005 μm to 0.030 μm and more preferably 0.01 μm to 0.025 μm. The pore diameter (median diameter) may be measured with a mercury porosimeter (trade name: PORESIZER 9320-PC2, manufactured by Shimadzu Corporation).

The inkjet recording media of the invention may be manufactured by use of an ordinary method. For example, a method for producing inkjet recording media, which is described in paragraphs [0160] to [0203] of JP-A No. 2008-246988, may be applied as well to produce inkjet recording media in the invention.

<Inkjet Recording Method>

An inkjet recording method of the invention is preferably configured by: a humidifying step for humidifying one side of an inkjet recording medium; a conveying step for conveying the humidified inkjet recording medium to a transporting path with the inkjet recording medium curled in a direction convex to the transporting path that transports the inkjet recording medium; a suctioning and transporting step for transporting the conveyed inkjet recording medium while suctioning to the transporting path; and a drawing step for drawing an image by applying an ink by an inkjet method on the inkjet recording medium suctioned to the transporting path. In this case, in the drawing step, two or more kinds of ink compositions are ejected to a porous layer containing inorganic microparticles and a water-soluble resin and having the porosity of 50% or more of the inkjet recording medium with the maximum total ejection amount set at less than 90% of the DEG absorption capacity in the porous layer. Furthermore, it is preferred to further include a drying step for drying by blowing air to a drawing surface side on which an image is drawn of the inkjet recording medium on which an image is drawn in the drawing step, and, in the humidifying step, a step for blowing air used in the drying step to one side of the inkjet recording medium.

Thereby, transporting failure during image formation is inhibited from occurring, high image quality is obtained and a recording speed is improved. Furthermore, a high quality image is obtained while achieving high-speed.

When an ink is applied according to the inkjet method, the inkjet recording method of the invention is preferably configured in an embodiment where two or more kinds of ink compositions are ejected so that the maximum total ejection amount relative to the DEG absorption capacity in the porous layer in the invention may be less than 90% by use of an image forming apparatus with a circulation device.

According to the configuration, in the invention, when an ink is ejected at a predetermined maximum total ejection amount to the porous layer in the invention to record, images of desired hue are stably obtained by inhibiting color from changing when a matter such as paper comes into contact with an image portion in a case where recording media are stacked in a relatively short time after recording. In addition to the above, ejection stability is rendered excellent.

<Image Forming Apparatus>

An image forming apparatus preferably used in the inkjet recording method of the invention will be described with reference to FIGS. 1 to 9.

Figure 2:
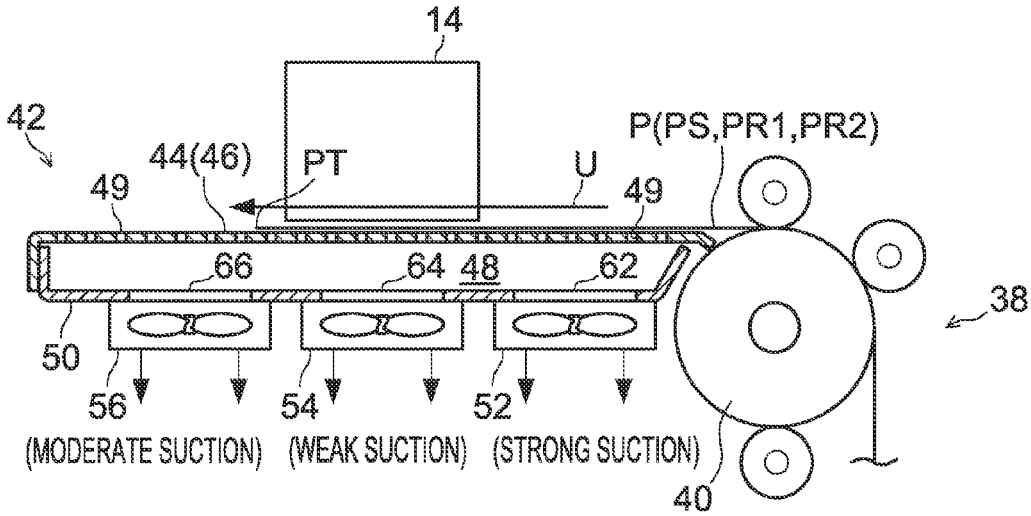
FIG. 2 is a cross-sectional side view showing a state where a recording paper is sucked and transported.
Figure 3:
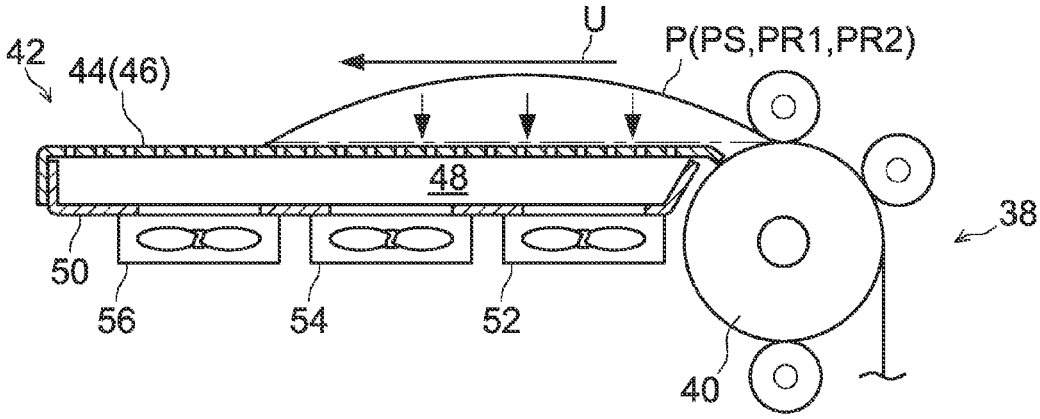
FIG. 3 is a cross-sectional side view for explaining a situation where a recording paper is transported without floating off from a transporting path.

In the beginning, as shown in FIGS. 1 and 2, an image forming apparatus 10 includes a drawing unit 12 that draws an image on an inkjet recording medium (hereinafter, in some cases, referred to as recording paper). The drawing unit 12 includes an inkjet recording head 14 ejecting ink droplets toward the recording paper and a carriage 16 for holding the inkjet recording head 14. Herein, a color image forming apparatus 10 that forms images with four colors of Y (yellow), M (magenta), C (cyan) and K (black) will be described. However, the invention may be applied as well to a monochromatic image forming apparatus.

The image forming apparatus 10 further includes a dryer 18 for blowing dry air to a recording paper side on which images are formed by the inkjet recording head 14 to solidify ink droplets; a cutter 20 for cutting the recording paper; a main transporting unit 22 for transporting the recording paper sequentially to the inkjet recording head 14, the dryer 18 and the cutter 20. The dryer 18 includes a blower fan and a heater disposed on an upstream side or a downstream side of the blower fan. In FIG. 1, the cutter 20 has two blades. However, the number of the blade may be one. The shorter a time from printing to drying is, the less the hue change (blur of magenta dye) of a gray image portion during storage of recorded articles is. A time from printing to drying is preferably within 10 seconds.

The image forming apparatus 10 further includes a sheet paper feeder 24 for feeding sheet recording papers; a first roll paper feeder 26 and a second roll paper feeder 28 for feeding a long recording paper. The sheet paper feeder 24 includes a paper feeding cassette 25 that houses recording papers so that a top side of the recording paper may be a side exposed to atmosphere. Any one of the recording papers fed from the sheet paper feeder 24, the first roll paper feeder 26 and the second roll paper feeder 28 are reversed by a sub-scanning roller 40 described below and fed to the main transporting unit 22.

-Transporting Mechanism-

Next, a transporting mechanism of the image forming apparatus 10 will be detailed including the main transporting unit 22.

The image forming apparatus 10 further includes: a sheet transporting unit 30 for transporting a sheet recording paper PS conveyed from the sheet paper feeder 24; a first roll transporting unit 32 for transporting a long recording paper PR1 wound off the first roll sheet feeder 26; and a second roll transporting unit 34 for transporting a long recording paper PR2 wound off the second roll sheet feeder 28 (hereinafter, for convenience of description, the recording papers PS, PR1 and PR2 will be generically described and explained as recording paper P).

The image forming apparatus 10 further includes a decurling and transporting unit 38 for transporting recording papers sent out of the sheet paper feeder 24, first roll paper feeder 26 and second roll paper feeder 28 to the main transporting unit 22 and for decurling a recording paper from a switchback transporting path 74 described below. The decurling and transporting unit 38 slightly decurls as well the recording paper PS fed from the sheet paper feeder 24.

The decurling and transporting unit 38 includes a sub-scanning roller 40 for feeding any of recording papers P transported from the sheet transporting unit 30, the first roll transporting unit 32 and second roll transporting unit 34 to the main transporting unit 22.

The sub-scanning roller 40 has, when the recording papers PS fed from the sheet paper feeder 24 are transported, a top side of the recording paper PS housed in the sheet paper feeder 24 as a surface on a winding side (that is, a surface abutting to a roller outer peripheral surface) and a drawing side as a surface wound so as to be an outer peripheral surface. Furthermore, the sub-scanning roller 40 has an inner peripheral surface side in a state before winding off as a surface on a winding side when the recording paper PR1 wound off the first roll sheet feeder 26 or the recording paper PR2 wound off the second roll feeder 28 is transported.

A suctioning and transporting unit 42 is disposed to the main transporting unit 22. The suctioning and transporting unit 42 transports a recording paper P conveyed out of the sub-scanning roller 40 to a region (that is, directly below the inkjet recording head 14) where images are drawn by the drawing unit 12 while suctioning the recording paper P, followed by further suctioning and transporting the recording paper P to a region blown by dry air from the dryer 18. The main transporting unit 22 includes a cutter transporting unit 21 that transports the recording paper P conveyed out of the suctioning and transporting unit 42 to a region where the recording paper P is cut by the cutter 20.

The suctioning and transporting unit 42 includes: a transporting path forming member 46 on an upper side of which a transporting path 44 is formed; and a concave air chamber forming member 50 that forms on a lower side of the transporting path 44 an air chamber 48 between the transporting path forming member 46 and the air chamber forming member 50. The transporting path forming member 46 includes many openings 49 for communicating the air chamber 48 and the upper side of the transporting path 44.

Furthermore, the suctioning and transporting unit 42 includes, on a lower side of the air chamber forming member 50, three suction fans 52, 54 and 56 sequentially along a transporting direction U of the suctioning and transporting unit 42. Openings 62, 64 and 66, respectively, are formed on a bottom side of the air chamber forming member 50 so that the suction fans 52, 54 and 56 respectively communicate with the air chamber 48. At transporting, the recording paper P is transported while being sucked to the transporting path 44 by using negative-pressure suction of the suction fans 52, 54 and 56.

In the image forming apparatus, the suction fans 52, 54 and 56 are disposed in such a manner that suction force of the suction fan 52 on a carry-in side of the transporting path 44, that is, the suction fan 52 closest to the sub-scanning roller 40, is strong (strong suction unit), suction force of the suction fan 54 that suctions directly below the inkjet recording head 14 is weak (weak suction unit), and suction force of the suction fan 56 on a take-out side of the transporting path 44, that is, the suction fan 56 closest to the dryer 18, is moderate (moderate suction unit). By forming such a suction force distribution along the transporting direction U of the transporting path 44, an adsorption force distribution is formed along the transporting direction U of the transporting path 44.

Figure 4:
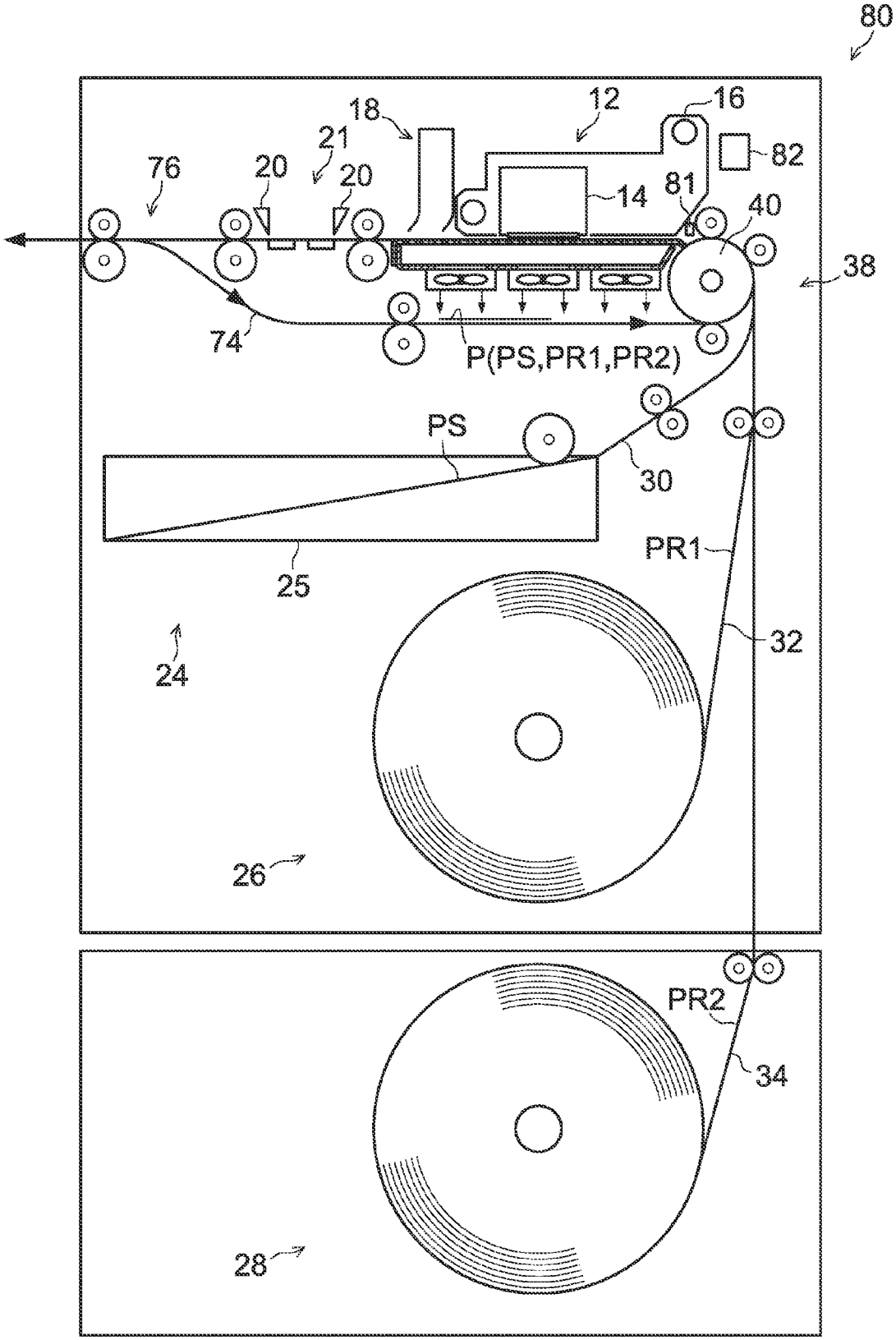
FIG. 4 is a side view showing another example of a configuration of an image forming apparatus.

In the invention, as shown in FIG. 4, a sensor 81 that detects a front edge position in the transporting direction of the recording paper P on the transporting path 44 and a controller 82 that controls the suction force of the respective suction fans 52, 54 and 56 based on signals received from the sensor 81 may be disposed. With the configuration, by the controller 82, the suction force distribution along the transporting direction U is controlled, and thereby, the adsorption force distribution on the transporting path 44 along the transporting direction U is controlled.

Thereby, the adsorption force distribution may be controlled in accordance with the transporting position of the recording paper P and an effect of transporting the recording paper P without floating a front edge thereof may be more remarkably exerted.

Figure 5A:
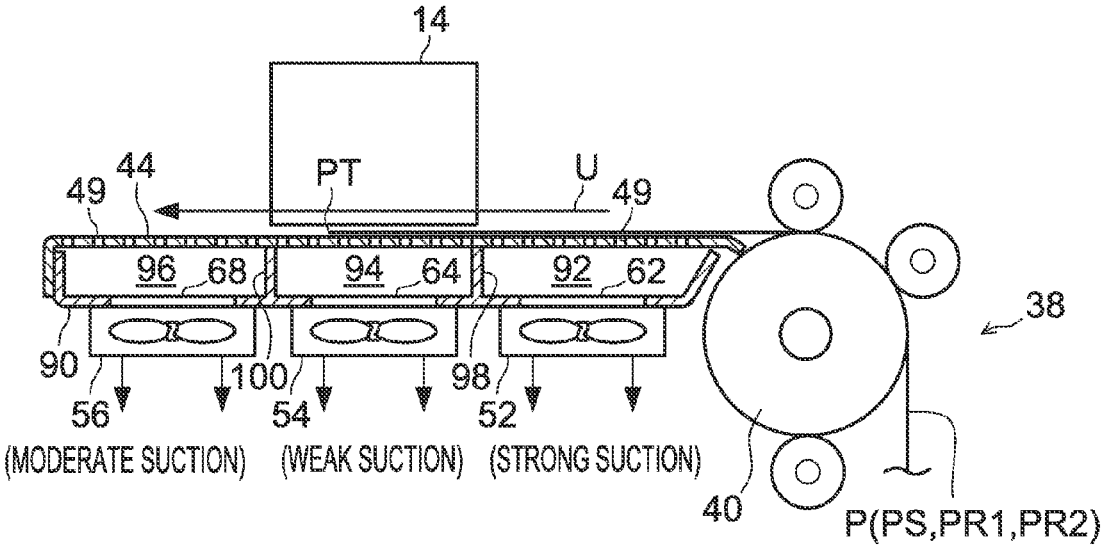
FIGS. 5A and 5B, respectively, are cross-sectional side views showing a state where a recording paper is sucked and transported.
Figure 5B:
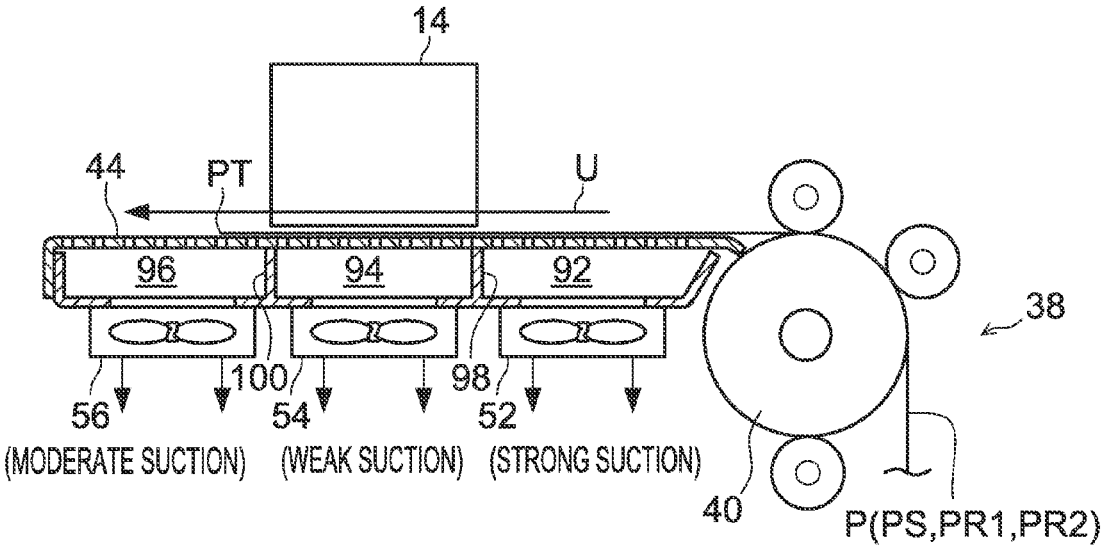

Furthermore, as shown in FIGS. 5A, 5B, the image forming apparatus in the invention may include an air chamber forming member 90 in place of the air chamber forming member 50. The air chamber forming member 90 includes partition wall units 98 and 100 between the transporting path forming member 46 and the air chamber forming member 90 so that three air chambers 92, 94 and 96 may be formed from an upstream side to a downstream side in the transporting direction U. The suction fans 52, 54 and 56, respectively, suck the air chambers 92, 94 and 96 with negative pressure. Accordingly, the suction fan 52 suctions strongly (suction high in flow rate), the suction fan 54 suctions weakly (suction low in flow rate) and the suction fan 56 suctions moderately (suction moderate in flow rate).

Figure 6:
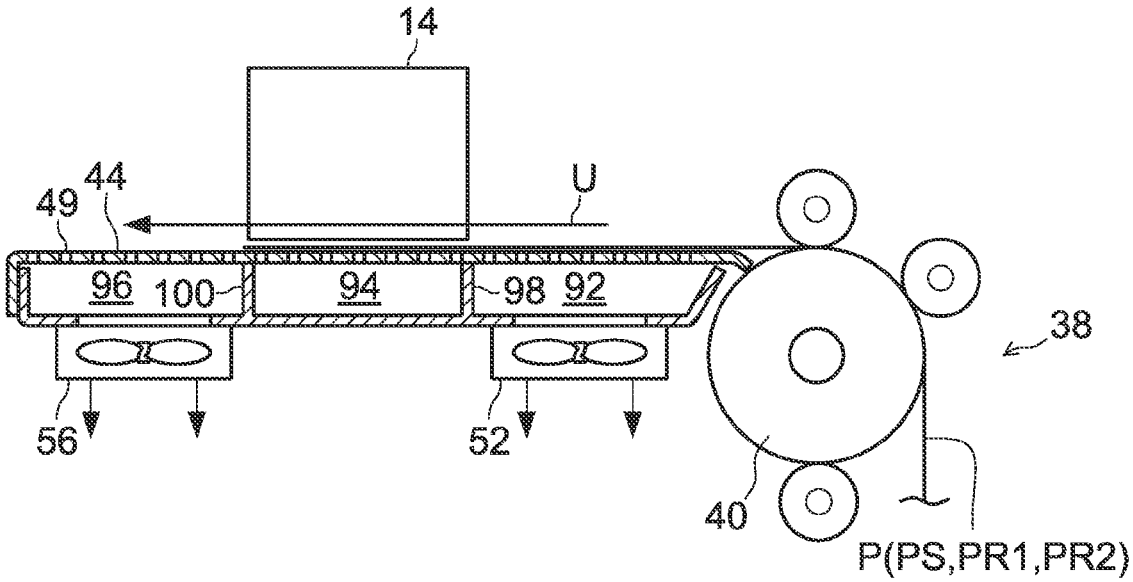
FIG. 6 is a cross-sectional side view showing an example of a suctioning and transporting unit of an image forming apparatus.

As shown in FIG. 6, a configuration where the air chamber 94 directly below the inkjet recording head 14 is not suctioned may be taken. Thereby, negative pressure suction that less disturbs an aerial flow directly below the inkjet recording head 14 is obtained.

Figure 7A:
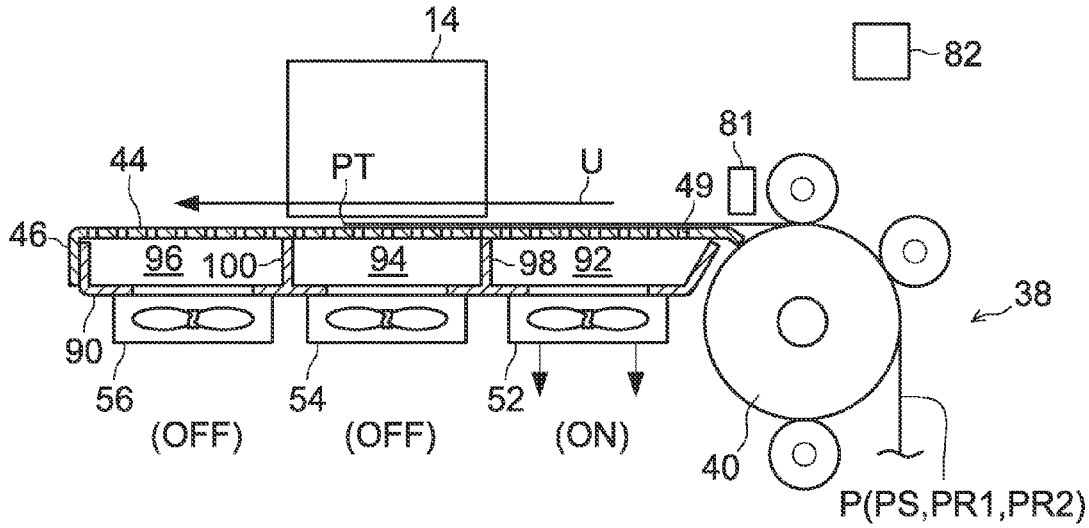
FIGS. 7A and 7B, respectively, are cross-sectional side views showing a state before a recording paper passes directly below an inkjet recording head, and a state after the recording paper has passed directly below the inkjet recording head.
Figure 7B:
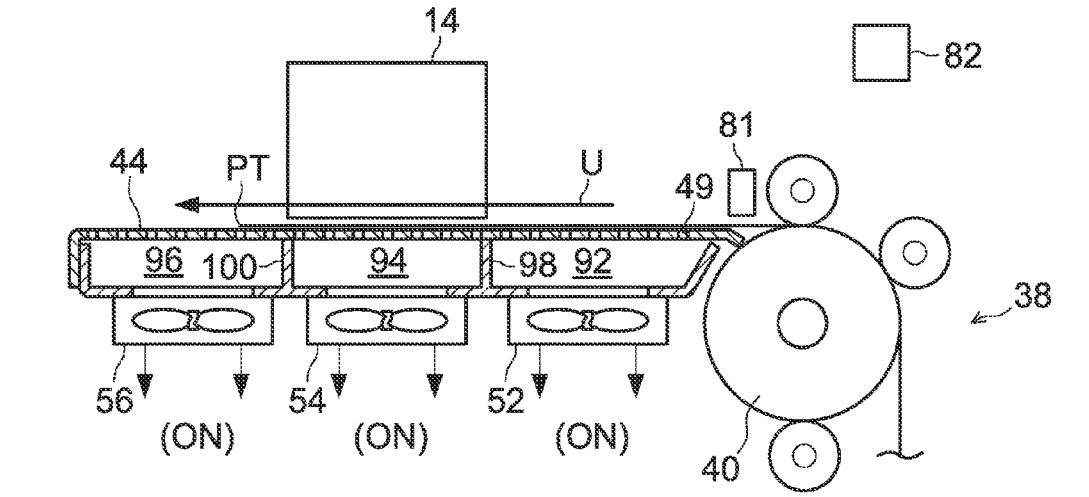

As shown in FIGS. 7A, 7B, the sensor 81 and the controller 82 may be disposed to control suctions of the suction fans 52, 54 and 56. Thereby, it is realized to control in such a manner that a position of the front edge PT of the recording paper P is detected by the sensor 81 and, until the front edge PT of the recording paper P goes past directly below the inkjet recording head 14, negative pressure suction from a position that is to face the recording paper P is not applied, that is, until the front edge PT of the recording paper P goes past directly below the inkjet recording head 14, the negative pressure suctions owing to the suction fans 54 and 56 are not applied. Accordingly, the negative pressure suction may be applied without disturbing an aerial flow directly below the inkjet recording head 14 and thereby an excellent image may be formed.

The image forming apparatus 10 includes a switchback transporting path 74 in parallel with the suctioning and transporting unit 42 and the cutter transporting unit 21 below the suctioning and transporting unit 42 and the cutter transporting unit 21. The switchback transporting path 74 branches from a branching unit 76 formed between a pair of transporting rollers 70A and 70B disposed immediately after a downstream side of the cutter transporting unit 21 and a pair of transporting rollers 72A and 72B disposed on a downstream side thereof and reaches the decurling and transporting unit 38. Air ejected from the suction fans 52, 54 and 56 is blown onto a top side of the recording paper P being transported on the switchback transporting path 74.

-Shutter-

Figure 8A:
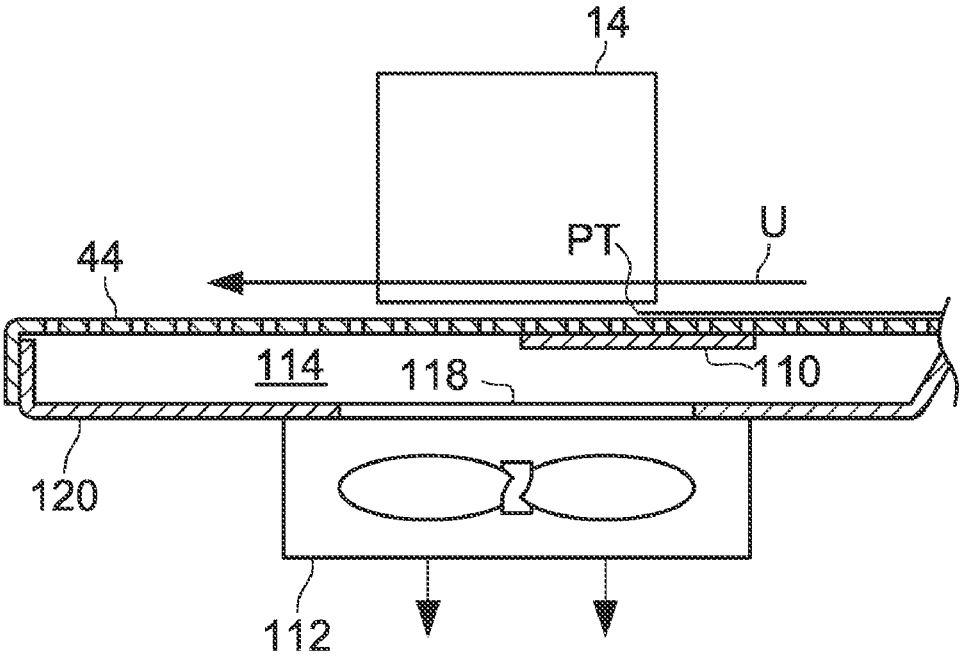
FIGS. 8A and 8B, respectively, are cross-sectional side views showing, directly below an inkjet recording head, a state where a shutter is located directly below a front edge in a transporting direction of a recording paper, and a state where the shutter is located directly below a back edge in a transporting direction of the recording paper.
Figure 8B:
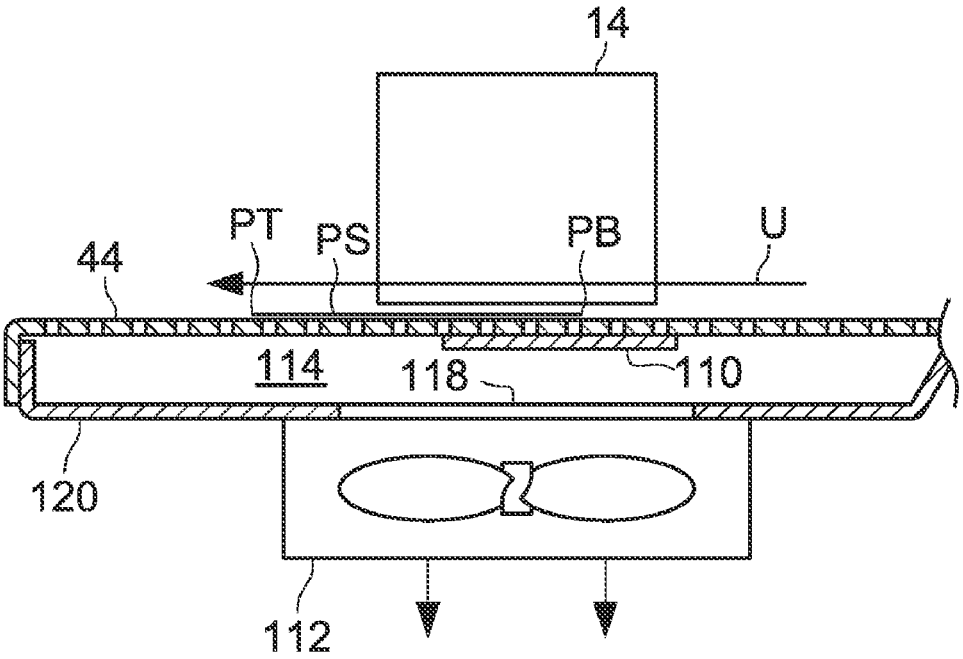

The image forming apparatus in the invention, as shown in FIGS. 8A, 8B, may include a shutter 110 capable of reciprocating along the transporting direction U on a lower side of the transporting path forming member 46. An adsorption force distribution of the transporting path 44 is made variable according to a movement position of the shutter 110.

A length of the shutter 110 in the transporting direction is set shorter than that of the sheet recording paper PS being transported. Arrangement positions of the openings 49 formed in the transporting path 44 are adjusted so that a region suctioned with negative pressure in the transporting path 44 may be a region more inside than both ends in a width direction of the recording paper PS (both ends in a direction orthogonal to the transporting direction U and both ends in a direction orthogonal to a plane of paper in FIGS. 8A, 8B).

In FIGS. 8A, 8B, in place of the three suction fans 52, 54 and 56, one suction fan 112 is disposed. Furthermore, an air chamber forming member 120 for forming an air chamber 114 is disposed on a lower side of the transporting path 44 in place of the air chamber forming member 50. In the air chamber forming member 120, one opening 118 that communicates the suction fan 112 and the air chamber 114 is formed.

A movement of the shutter 110 in the vicinity of the inkjet recording head 14 is controlled by a controller 82. The controller 82 moves the shutter 110 in synchronization with passes of a front edge PT and a back edge PB of the recording paper P to open or close the opening 118.

When a sheet recording paper PS is transported as the recording paper P in such an image forming apparatus, as shown in FIG. 8A, when a front edge PT of the recording paper PS goes past directly below the inkjet recording head 14, the shutter 110 is position-controlled so as to shield directly below a circumference of the front edge PT. And, as shown in FIG. 8B, when a back edge PB of the recording paper PS goes past directly below the inkjet recording head 14, the shutter 110 is position-controlled so as to shield directly below a circumference of the back edge PB.

Thereby, directly below the inkjet recording head 14, without assuredly disturbing an aerial flow in the circumference of the front edge PT and back edge PB of the recording paper PS, the negative pressure suction is applied. This is particularly effective when an image is formed up to a brim of a front edge of the recording paper PS (for example, when an image is formed in a brimless print). Furthermore, the number of the suction fans may be reduced.

In the case where a long recording paper PR1 or PR2 is transported as the recording paper P to draw, when a front edge PT of the recording paper PR1 or PR2 goes past directly below the inkjet recording head 14, the shutter 110 has only to be position-controlled so as to shield directly below the front edge PT and the circumference thereof.

-Dryer-

Figure 9:
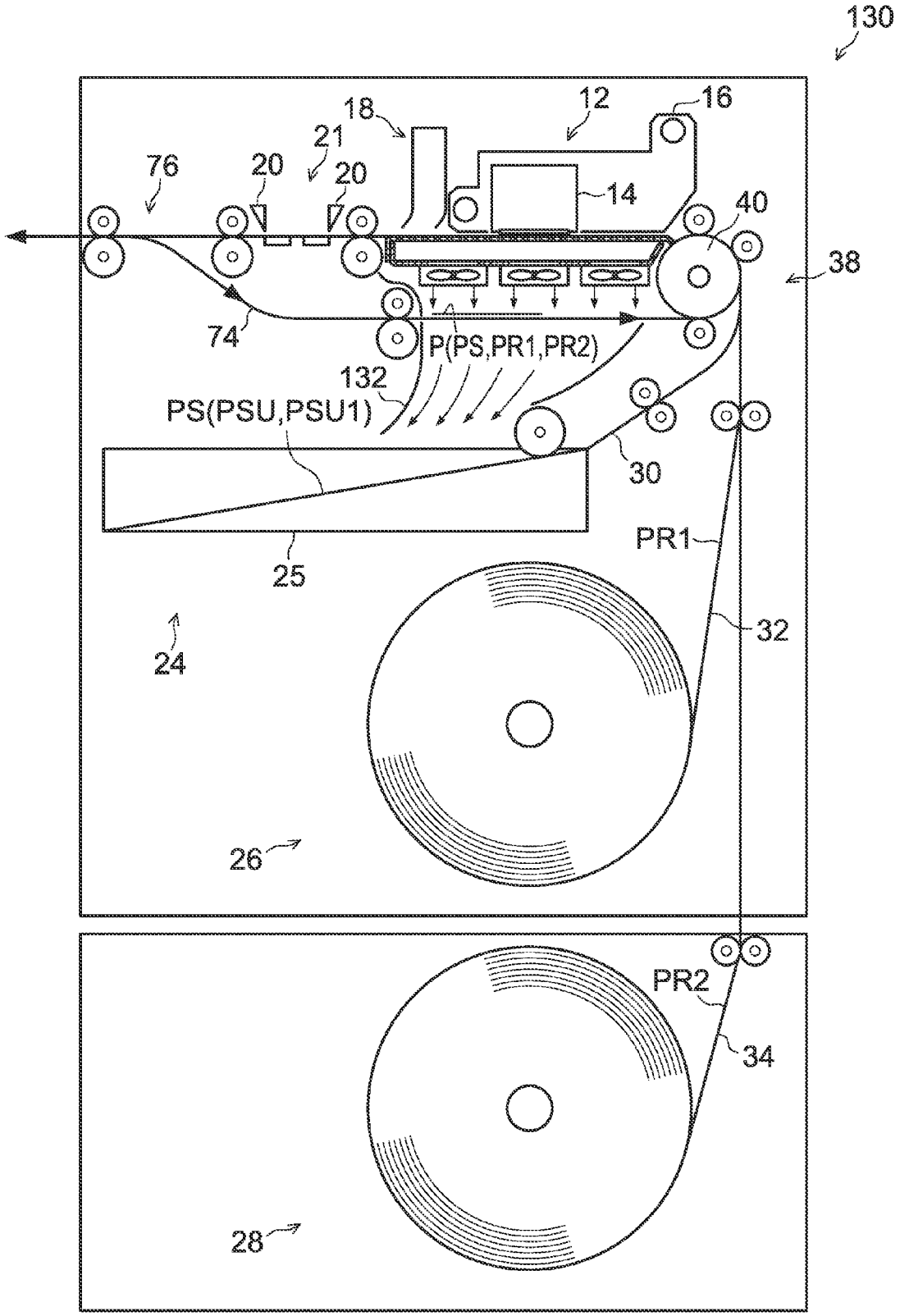
FIG. 9 is a side view showing yet another example of a configuration of an image forming apparatus.

In the image forming apparatus of the invention, as shown in FIG. 9, a duct 132 where hot air blown from the dryer 18 toward the recording paper immediately after conveying out of the drawing unit 12 and air discharged from the switchback transporting path 74 are mixed and blown on a top side of the sheet recording paper PS housed in the paper feeding cassette 25 may be disposed.

In such an image forming apparatus, one surface that is a top side of the upper most recording paper PSU of the recording papers PS in the paper feeding cassette 25 is lower in the hygroscopicity than a bottom side thereof and higher in the temperature than a bottom side thereof and tends to be curled so as to be concave toward one surface side.

Accordingly, when such a recording paper PSU is conveyed out of the paper feeding cassette 25 to the decurling and transporting unit 38 and further conveyed from the sub-scanning roller 40 to the suctioning and transporting unit 42, since one surface is on a transporting path side, the recording paper PSU is fed in a state where the recording paper is sufficiently curled in a direction convex to the transporting path 44.

In addition, a temperature of air of the dryer 18 is effective to humidify even at room temperature. However, when the temperature is set around 70° C., a remarkable humidifying effect may be obtained.

In such an image forming apparatus, hot air blown from the dryer 18 toward the recording paper immediately after conveying out of the drawing unit 12 and air suctioned with negative pressure for suctioning the recording paper to the transporting path 44 are made use of to humidify one surface of the recording paper PSU of the paper feeding cassette 25. Accordingly, a humidifying mechanism is simplified in its configuration and the recording paper PSU is humidified effectively in a shorter time; accordingly, energy saving effect is obtained.

Furthermore, even when the adsorption force distribution mentioned above is not formed, the transporting path 44 may suction and transport the recording paper PSU with the front edge of the recording paper PSU sufficiently inhibited from floating. Still furthermore, even when an effect of the decurling process by the decurling and transporting unit 38 is not large, the transporting path 44 may suction and transport the recording paper PSU with the front edge of the recording paper PSU sufficiently inhibited from floating; accordingly, a degree of freedom for designing the decurling and transporting unit 38 is largely expanded.

By setting the temperature of hot air blowing from the dryer 18 at around 70° C., drying during transportation on the switchback transporting path 74 is accelerated and a temperature of the recording paper is elevated, and thereby a decurling effect in the decurling and transporting unit 38 may be sufficiently obtained.

When one surface of the recording paper PSU is formed to be sufficiently concave by humidification as described above, in place of the decurling and transporting unit 38, a mechanism that does not have a decurling process and only transports to the transporting path 44 may be disposed. Thereby, the image forming apparatus may be formed smaller.

In such an image forming apparatus, hot air blown from the dryer 18 toward the recording paper immediately after conveying out of the drawing unit 12 is mixed with air discharged from the switchback transporting path 74 and the mixed air is blown onto a top side of the recording paper PSU in the paper feeding cassette 25. However, the hot air blown from the dryer 18 may be directly blown onto a top side of the recording paper PSU in the paper feeding cassette 25. Thereby, the recording paper PSU in the paper feeding cassette 25 is further heated and expedited to dry on a top side thereof and tends to be further deformed into a shape concave upward (concave to the switchback transporting path 74).

Next, a method for carrying out the image forming method of the invention with the image forming apparatus mentioned above will be described. The recording paper PS that is sent forth from the paper feeding cassette 25 to the decurling and transporting unit 38 and further sent forth intermittently from the scanning roller 40 to the suctioning and transporting unit 42 is slightly decurled at the decurling and transporting unit 38 and sent out on the transporting path 44, while the recording paper PS being curled in a direction slightly convex to the transporting path 44.

Then, owing to a strong suction force by the suction fan 52, the recording paper PS is transported from the front edge PT of the recording paper PS while suctioning and holding by the transporting path 44. Herein, as shown in FIGS. 8A, 8B, when the adsorption force does not work, the recording paper P(PS, PR1, or PR2) curls in a direction slightly convex to the transporting path 44, and when the adsorption force works, the recording paper PS is made flat along a shape of the transporting path and transported. Accordingly, the front edge PT does not float off the transporting path 44 different from the case where the recording paper PS is curled in a direction concave to the transporting path 44. That is, in the case where the recording paper is curled in a direction concave to the transporting path, with the recording paper assumed as a beam, as a distance between a contact point of a floating portion on the front edge side of the recording paper with the transporting path 44 and a front edge of the recording paper becomes smaller, a length of the beam becomes smaller and a suction force necessary for suctioning the front edge of the recording paper to the transporting path increases. However, the image forming apparatus of the invention may avoid such a situation.

Furthermore, owing to such curling, a back edge as well of the recording paper PS does not float off the transporting path 44. Even when the suction force of the suction fan 54 directly below the inkjet recording head 14 is weak owing to such curling, the front edge PT and back edge do not float off the transporting path 44.

The recording paper PS is transported on the transporting path 44 as described above and at the drawing unit 12, an image is drawn on a top side of the recording paper PS with ink droplets ejected from the inkjet recording head 14. A solvent contained in the ejected ink droplets is adsorbed by a coated layer of the recording paper PS or fibers of the paper and a top side of the recording paper adsorbs moisture more than a bottom surface side and expands. Accordingly, in the recording paper PS, force that curls the recording paper PS more convex to a top side works.

Then, the recording paper PS that was blown with hot air from the dryer 18 and went sequentially past the cutter transporting unit 21 and the branching unit 76, when only one surface is drawn, is conveyed out of a pair of transporting rollers 72A and 72B, and when image are drawn on both surfaces, is transported on the switchback transporting path 74 after a transporting direction is switched to a reverse direction. During transportation on the switchback transporting path 74, air ejected from the suction fans 52, 54 and 56 is blown on a top side of the recording paper PS. Herein, an air temperature inside of the apparatus is elevated by an action of the dryer 18 of the image forming apparatus 10 and humidity is lowered relative to atmosphere. Accordingly, the hygroscopicity on the top side of the recording paper PS becomes lower and a temperature thereof is elevated.

Furthermore, the recording paper PS is further transported from the switchback transporting path 74 to the decurling and transporting unit 38 to be decurled. Thus, the top side of the recording paper PS, that is lowered in the hygroscopicity and elevated in a temperature on the switchback transporting path 74 and is further decurled by the decurling and transporting unit 38, is reversed in a curling direction. That is, the recording paper PS conveyed out of the decurling and transporting unit 38 is curled convexly upward, namely, curled convex to the transporting path 44. Accordingly, when the recording paper PS is transported on the transporting path 44 for the second image formation (image formation on an opposite side), similar to the first image formation, the recording paper PS is transported in a shape along a shape of the transporting path and a front edge thereof does not float off the transporting path 44 different from the case where a front edge of a recording paper is curled in a direction concave to the transporting path 44.

With the recording paper PS transporting on the transporting path 44 as described above, an image is drawn on a top side of the recording paper PS with droplets of an ink ejected from the inkjet recording head 14. Then, the recording paper PS is dried by hot air from the dryer 18 and conveyed out after going sequentially past the cutter transporting unit 21, the pair of transporting rollers 70A and 70B, the branching unit 76 and the pair of transporting rollers 72A and 72B.

As described above, in the image forming apparatus in the invention, irrespective of a case where an image is formed on one side and a case where an image is formed on each of both sides by use of the switchback transporting path 74, the recording paper PS is transported in a shape along a shape of the transporting path, and thereby a front edge of the recording paper does not float off the transporting path 44 different from a case where a front edge of the recording paper is curled in a direction concave to the transporting path 44.

Furthermore, directly below the inkjet recording head 14, the suction fan 54 that suctions with the weakest suction force among the three suction fans 52, 54 and 56 is disposed. Accordingly, below the inkjet recording head 14, a strong aerial flow that disturbs ink droplets from landing in an intended position is inhibited from occurring. This is particularly effective when an image is formed up to a brim of a front edge of the recording paper PS (for example, a case where an image is formed as a brimless print).

The recording paper PR1 fed from the first roll paper feeder 26 and the recording paper PR2 fed from the second roll paper feeder 28 are wound in a roll before feeding; accordingly, a curling direction thereof is already determined when these are wound off. That is, the recording papers PR1 and PR2 fed to the transporting path 44 are curled beforehand in a direction convex to the transporting path 44. Accordingly, equivalent or better than a case where images are formed on both sides of the sheet recording paper PS fed from the sheet paper feeder 24, the recording paper PS is excellently transported on the transporting path 44 and excellent images are formed on both sides thereof.

In the image forming apparatus of the invention, during transportation on the switchback transporting path 74, air ejected from the suction fans 52, 54 and 56 is blown onto a top side of the recording paper P to lower the hygroscopicity on the top side of the recording paper P and elevate a temperature on the top side of the recording paper P. However, hot air blown from the dryer 18 to the recording paper P immediately after conveying out of the drawing unit 12 may be introduced in air ejected from the suction fans 52, 54 and 56. Thereby, the top side of the recording paper P being transported on the switchback transporting path 74 is more heated and expedited in drying and tends to be further deformed in a shape concave upward; accordingly, the recording paper P gone past the decurling and transporting unit 38 tends to be further convex to the transporting path 44 of the suctioning and transporting unit 42. As a result, the decurling capability of the decurling and transporting unit 38 is not required to be so high, and furthermore, a mechanism that does not decurl and only transports to the transporting path 44 may be disposed in place of the decurling and transporting unit 38.

All publications, patent applications, and technical standards mentioned in this specification are herein incorporated by reference to the same extent as if each individual publication, patent application, or technical standard was specifically and individually indicated to be incorporated by reference.

EXAMPLES

Hereinafter, the present invention will be more specifically described by way of Examples. The scope of the invention is not intended to be limited to the specific examples shown below. In particular, unless stated otherwise, the terms "part" and "%" are based on weight.

Example 1

<<Preparation of Inkjet Recording Medium>>

-Preparation of Water-Impermeable Support- 50 parts of LBKP obtained from acacia and 50 parts of LBKP obtained from aspen were respectively processed by beating using a disc refiner to obtain a Canadian freeness of 300 mL, and thus a pulp slurry was prepared.

Subsequently, to the pulp slurry obtained as described above were added 1.3% of cationic starch (trade name: CAT 0304L, manufactured by Nippon NSC, Ltd.), 0.15% of anionic polyacrylamide (trade name: DA4104, manufactured by Seiko PMC Corp.), 0.29% of an alkyl ketene dimer (trade name: SIZEPINE K, manufactured by Arakawa Chemical Industries, Ltd.), 0.29% of epoxidated behenic acid amide, and 0.32% of polyamide-polyamine-epichlorohydrin (trade name: ARAFIX 100, manufactured by Arakawa Chemical Industries, Ltd.), based on the pulp, and thereafter 0.12% of an antifoaming agent was added thereto.

The pulp slurry prepared as described above was made into paper using a Fourdrinier paper machine. In a process of drying the paper by pressing the felt surface of the web in a drum dryer cylinder, with a dryer canvas interposed between the felt surface and the dryer cylinder, drying was performed with the tensile strength of the dryer canvas set at 1.6 kg/cm, and then polyvinyl alcohol (trade name: KL-118, manufactured by Kuraray Co., Ltd.) was coated by size pressing in an amount of 1 g/m$^2$ on both sides of a base paper. The coated base paper was dried and was subjected to a calendering treatment. The base paper was made to have a basis weight of 157 g/m$^2$, and thus a base paper (substrate paper) having a thickness of 157 μm was obtained.

After performing a corona discharge treatment on one surface of the obtained substrate paper, polyethylene having a density of 0.93 g/cm$^3$ and containing 10% by weight of titanium oxide was coated thereon in an amount of 24 g/m$^2$ using a melt extruder at 320° C. Subsequently, a corona discharge treatment was performed also o the other surface, and then, polyethylene having a density of 0.93 g/cm$^3$ and containing 10% by weight of titanium oxide was coated thereon in an amount of 24 g/m$^2$ using a melt extruder at 320° C.

Thus, a polyethylene resin coated paper having coated with polyethylene (water-impermeable support) on both sides was formed.

-Preparation of Coating Solution for Ink-Receiving Layer (Porous Layer)-

(1) Vapor-phase process silica microparticles, (2) ion-exchanged water, (3) "SHAROL DC-902P" (trade name), and (4) "ZA-30" (trade name) shown in the following composition were mixed and dispersed using a liquid-liquid collision disperser (trade name: ULTIMIZER, manufactured by Sugino Machine LIMITED). Then, the resulting dispersion liquid was heated to 45° C. and kept there for 20 hours. Thereafter, (5) boric acid, (6) a polyvinyl alcohol solution, and (7) cation-modified polyurethane were added to the dispersion liquid at 30° C., and thereby an ink-receiving layer coating solution was prepared.

In the ink-receiving layer coating solution, a solid content ratio of vapor-phase process silica microparticles to polyvinyl alcohol (PB ratio=(1)/(6)) was 4.9, and pH of the ink-receiving layer coating solution was 3.4 and acidic.

<Composition of Ink-Receiving Layer Coating Solution>

(1) Vapor-phase process silica microparticles (inorganic microparticles) . . . 8.9 parts by weight (trade name: ΔEROSIL 300SF75, manufactured by NIPPON AEROSIL Co., Ltd.)

(2) Ion-exchanged water . . . 47.3 parts by weight (3) "SHAROL DC-902P" (51.5% by weight aqueous solution) . . . 0.78 parts by weight (dispersing agent, nitrogen-containing organic cationic polymer, manufactured by DAI-ICHI KOGYO SEIYAKU Co., Ltd.)

(4) "ZA-30" . . . 0.48 parts by weight (trade name, zirconyl acetate, manufactured by DAIICHI KIGENSO KAGAKU KOGYO Co., Ltd.)

(5) Boric acid (7.5% by weight aqueous solution) . . . 4.38 parts by weight (6) Polyvinyl alcohol (water-soluble resin) solution . . . 26.0 parts by weight <Composition of Solution>

JM33 . . . 1.81 parts by weight (polyvinyl alcohol; degree of saponification 95.5%, degree of polymerization 3300; manufactured by JAPAN VAM & POVAL Co., Ltd.)

HPC-SSL (water-soluble cellulose, manufactured by NIPPON SODA Co., Ltd.) . . . 0.08 parts by weight Ion-exchanged water . . . 22.96 parts by weight Diethylene glycol monobutyl ether . . . 0.55 parts by weight (trade name: BUTYCENOL 20P, manufactured by Kyowa Hakko Chemical CO., LTD.)

EMULGEN 109P (trade name, surfactant, manufactured by Kao Corporation) . . . 0.6 parts by weight (7) Cation-modified polyurethane . . . 1.8 parts by weight (trade name: SUPERFLEX 650-5 (25% solution), manufactured by DAI-ICHI KOGYO SEIYAKU Co., Ltd.)

-Formation of Ink-Receiving Layer (Porous Layer)-

One side of a water-impermeable support above obtained was subjected to a corona discharge treatment. On the one side, the ink-receiving layer coating solution was coated as described below by an extrusion die coater to form a coated layer. Specifically, the ink-receiving layer coating solution was set at 150 g/m$^2$ and an in-line solution described below was in-line mixed therewith at a speed (coating amount) of 10 g/m$^2$, followed by coating on the water-impermeable support.

<Composition of In-line Solution>

(1) ALFINE 83 . . . 2.0 parts by weight (trade name, manufactured by Taimei Chemical Co., Ltd.; aqueous solution of polyaluminum chloride)

(2) Ion-exchanged water . . . 7.8 parts by weight (3) HYMAX SC-507 . . . 0.2 parts by weight (trade name, manufactured by HYMO Co., Ltd.; dimethylamine/epichlorohydrin polycondensate)

The coated layer formed by coating was dried by a hot air dryer at 80° C. (air velocity: 3 msec to 8 msec) until a solid concentration of the coated layer may be 36% by weight. During the drying process, the coated layer showed a constant rate period of drying. Immediate thereafter, the coated layer was dipped for 3 seconds in a solution containing a basic compound having a composition shown below to absorb the solution at 13 g/m$^2$ on the coated layer, followed by drying at 72° C. for 10 minutes (drying step), whereby an ink-receiving layer was formed on one side of the water-impermeable support.

A thickness of the ink-receiving layer was 27 μm, and the DEG absorption capacity of a surface thereof was 18 mL/m$^2$. The porosity of the ink-receiving layer (=DEG absorption capacity/layer thickness×100) was 67%.

<Solution Containing Basic Compound>

(1) Boric acid . . . 0.65 parts by weight (2) Ammonium carbonate (first grade, manufactured by KANTO CHEMICAL CO., INC.) . . . 5.0 parts by weight (3) Ion-exchanged water . . . 88.35 parts by weight (4) Polyoxyethylene lauryl ether (surfactant) . . . 6.0 parts by weight (EMULGEN 109P (trade name, 10% aqueous solution, HLB value: 13.6, manufactured by Kao Corporation)

-Measurement of DEG Absorption Capacity of Ink-receiving Layer-

The DEG absorption capacity was measured according to a method shown below.

Onto a surface of an ink-receiving layer of a test piece obtained by cutting an inkjet recording paper into a 10 cm square, 1 mL of diethylene glycol was added dropwise and an excess amount was wiped off after 30 seconds. An absorption capacity (mL/m$^2$) of diethylene glycol was obtained from weight difference before and after the dropwise addition. Results are shown in Table 1.

As mentioned above, a roll inkjet recording paper provided with an ink-receiving layer having a dry film thickness of 27 μm on a support was obtained. The roll inkjet recording paper was slit into a roll of 152 mm width×100 m length and used as an evaluation roll sample.

<<Image Recording>>

Images were recorded on the above-obtained inkjet recording paper under an environment of 25° C. and 60% RH by use of an inkjet recording unit shown in FIG. 9 and recorded images were evaluated. As the ink for recording images, inks of four colors of Y (yellow), M (magenta), C (cyan) and K (black) for FRONTIER DRY MINILAB DL410 (trade name, manufactured by FUJI FILM CORPORATION) were used.

In this process, when a roll of the inkjet recording paper prepared in a roll was mounted and the ink jet recording apparatus was started, the inkjet recording paper was fed. While transporting the inkjet recording paper at a constant speed in a sub-scanning direction, from line heads wherein nozzles are arranged in matrix (two-dimensionally), inks of the respective colors were sequentially ejected under ejection conditions of an amount of ink droplets of 5 pL (maximum ejection amount of one dot: 11 mL/m$^2$, ink total amount: 135%), the maximum total ejection amount 15 mL/m$^2$ (<DEG absorption capacity×0.9), ejection frequency: 30 kHz, and resolution of 1200 dpi×1200 dpi, and thereby gray solid images were recorded. A traveling speed in this process was 1000 mm/sec. Furthermore, a tone of image data was adjusted so that a gray density measured by use of GRETAG SPECTROLINO SPM-50 (trade name, manufactured by Gretag Macbeth Co.; view angle: 2°, light source: D50, with no filter) was 1.7.

After the end of ejection, the inkjet recording paper was cut in sheet at 5 seconds after the end of ejection and dried. In this process, dry air having a temperature of 30° C. was fed. After the end of drying, the sheet inkjet recording papers on which a solid image was recorded were further transported and recovered by stacking in a not shown recovery unit.

Thus, a gray image was obtained on the inkjet recording papers.

-Evaluation- (Color Change)

A change of color tone (color change) of the resulting gray images was evaluated as shown below.

Immediate after the recovery (within 3 minutes after the end of drying) and 24 hours after the recovery, respectively, L*a*b* based on a CIE-LAB uniform color space diagram of the gray solid image was measured by use of a spectrophotometer SPECTROLINO (trade name, manufactured by Gretag Macbeth Co.) under conditions of view angle: 2°, light source: F8, with no filter, and a color difference (ΔE) was obtained from the respective measurements as a barometer for evaluating the color tone change. In the evaluation, a value of color difference was evaluated according to the following evaluation criteria. Results of the evaluation are shown in Table 1 described below.

<Evaluation Criteria>

Rank A: ΔE<2; color tone change is hardly observed.

Rank B: 2≦ΔE<4; color tone change is observed slightly but not conspicuously.

Rank C: 4≦ΔE<7; color tone change is observed conspicuously.

Rank D: ΔE≧7; color tone change is observed remarkably.

(Blurring)

Under the ejection conditions substantially the same as those mentioned above, several tens of points of 0.05 mm×0.05 mm point of gray image (R: 255, G: 255, B: 255) were printed on each of the inkjet recording papers at an interval of 0.02 mm and the resulting printed samples were stored under an environment of 23° C./90% RH for 120 hours. Hues of a gray image portion before and after storage were measured by use of a spectrophotometer SPECTROLINO (trade name, manufactured by Gretag Macbeth Co.), a color difference (ΔE) was obtained from the measurements, and the blurring was evaluated according to the evaluation criteria described below. Results of the evaluation are shown in Table 1 shown below.

<Evaluation Criteria>

Rank A: $\Delta E \leqq 3$; blurring is hardly observed.

Rank B: $3 < \Delta E \leqq 6$; blurring is observed.

Rank C: $6 < \Delta E \leqq 9$; blurring is bad.

Rank D: $\Delta E > 9$; blurring is very bad.

(Brittleness)

The resulting inkjet recording papers were stored for one day in a constant temperature and humidity chamber set at a temperature of 10° C. and relative humidity of 20%. Thereafter, the inkjet recording paper was wound around a cylindrical column with the ink-receiving layer directed outwards and the brittleness of the ink-receiving layer was evaluated. The smaller a diameter of the cylindrical column is, the more readily the ink-receiving layer tends to be cracked; accordingly, a diameter [mm] of a cylindrical column at a limit where the crack is generated was taken as a value of the brittleness. Results of the evaluation are shown in Table 1 described below.

<Evaluation Criteria>

Rank A: limit diameter is less than 30 mm, that is, an excellent level.

Rank B: limit diameter is from 30 mm to 40 mm, that is an allowable level.

Rank C: limit diameter exceeds 40 mm, that is a level exceeding an allowable level.

(Transportation Trouble)

Over an entire surface of each of the resulting 100 inkjet recording papers, a black solid image was printed by an intermittent transportation at a transporting speed of 1000 mm/sec (maximum speed). Based on the number of papers printed on both sides thereof and ejected in an ejected paper tray, the transportability was evaluated according to the evaluation criteria described below. Results of the evaluation are shown in Table 1 described below.

<Evaluation Criteria>

Rank A: all papers are ejected.

Rank B: one paper is not ejected.

Rank C: two papers are not ejected.

Rank D: three or more papers are not ejected.

(Color Density)

Under the ejection conditions substantially the same as those in the evaluation of the color change, a black solid image was printed on each of the inkjet recording papers, and resulting printed samples were stored under an environment of 23° C./50% RH for 24 hours. Density of the black solid image portion after the storage was measured by X-rite 310 TR (trade name, manufactured by Gretag Macbeth Co., Ltd.), and the color density was evaluated from the measurements according to the evaluation criteria shown below. Results of the evaluation are shown in Table 1 described below.

<Evaluation Criteria>

Rank A: coloring density of the black solid image portion is 2.5 or more.

Rank B: coloring density of the black solid image portion is 2.3 or more and less than 2.5.

Rank C: coloring density of the black solid image portion is 2.1 or more and less than 2.3.

Rank D: coloring density of the black solid image portion is less than 2.1.

Example 2

An ink-receiving layer was formed in a manner substantially similar to that in Example 1 except that, in Example 1, a coating amount of an ink-receiving layer coating solution was changed from 150 g/m$^2$ to 175 g/m$^2$, and an in-line solution was in-line mixed by changing a velocity (coating amount) of the in-line solution from 10 g/m$^2$ to 11.7 g/m$^2$, followed by coating on a water-impermeable support, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

Example 3

An ink-receiving layer was formed in a manner substantially similar to that in Example 2 except that, in Example 2, an amount of the (6) polyvinyl alcohol solution in "Composition of Ink Receiving Layer Coating Solution" was changed from 26.0 parts by weight to 36.4 parts by weight, and thereby an inkjet recording paper was obtained. A thickness of the ink-receiving layer, the DEG absorption capacity and porosity thereof are as shown in Table 1 shown below. Furthermore, evaluations substantially the same as Example 1 were performed.

Example 4

An ink-receiving layer was formed in a manner substantially similar to that in Example 1 except that, in Example 1, an amount of the (6) polyvinyl alcohol solution in "Composition of Ink-receiving Layer Coating Solution" was changed from 26.0 parts by weight to 19.3 parts by weight, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

Example 5

An ink-receiving layer was formed in a manner substantially similar to that in Example 1 except that, in Example 1, (1) ALFINE 83 in "Composition of In-line Solution" was not added, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

Example 6

An ink-receiving layer was formed in a manner substantially similar to that in Example 5 except that, in Example 5, (4) ZA-30 and (7) cation-modified polyurethane in "Composition of Ink-receiving Layer Coating Solution" were not added, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

Example 7

A gray tone image was obtained in a manner substantially similar to that in Example 1 except that, in Example 1, an inkjet recording paper was cut at 15 seconds after the end of ejection. A thickness of the ink-receiving layer, the DEG absorption capacity and porosity thereof are as shown in Table 1 shown below. Furthermore, evaluations similar to those in Example 1 were performed.

Example 8

An ink-receiving layer was formed in a manner substantially similar to that in Example 1 except that, in Example 1, compositions of an ink-receiving layer coating solution and a solution containing a basic compound, respectively, were changed to compositions shown below, a coating amount of an ink-receiving layer was changed from 150 g/m$^2$ to 132 g/m$^2$, and an in-line solution was in-line mixed by changing a velocity (coating amount) of the in-line solution from 10 g/m$^2$ to 9.2 g/m$^2$ and coated on a water-impermeable support, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

<Composition of Ink-Receiving Layer Coating Solution>

(1) Vapor-phase process silica microparticles (inorganic microparticles) . . . 8.9 parts by weight (trade name: ΔEROSIL 300SF75, manufactured by NIPPON AEROSIL Co., Ltd.)

(2) Ion-exchanged water . . . 44.5 parts by weight (3) "SHAROL DC-902P" (51.5% by weight aqueous solution) . . . 0.78 parts by weight (dispersing agent, nitrogen-containing organic cationic polymer, manufactured by DAI-ICHI KOGYO SEIYAKU Co., Ltd.)

(4) "ZA-30" . . . 0.48 parts by weight (trade name, manufactured by DAIICHI KIGENSO KAGAKU KOGYO Co., Ltd., zirconyl acetate)

(5) Boric acid (7.5% by weight aqueous solution) . . . 4.38 parts by weight (6) Polyvinyl alcohol (water-soluble resin) solution . . . 26.0 parts by weight <Composition of Solution>

PVA-235 . . . 1.81 parts by weight (polyvinyl alcohol; degree of saponification 88%, degree of polymerization 3500; manufactured by KURARAY Co., Ltd.)

Ion-exchanged water . . . 23.5 parts by weight

Diethylene glycol monobutyl ether . . . 0.27 parts by weight (trade name: BUTYCENOL 20P, manufactured by KYOWA HAKKO CHEMICAL Co., Ltd.)

EMULGEN 109P (trade name, surfactant, manufactured by Kao Corporation) . . . 0.06 parts by weight (7) Cation-modified polyurethane . . . 1.8 parts by weight (trade name: SUPERFLEX 650-5, 25% solution, manufactured by DAI-CHI KOGYO SEIYAKU Co., Ltd.)

(8) Methanol . . . 3.15 parts by weight

<Solution Containing Basic Compound>

(1) Ammonium carbonate (first grade: manufactured by KANTO CHEMICAL CO., INC) . . . 5.0 parts by weight (2) Ion-exchanged water . . . 88.35 parts by weight (3) Polyoxyethylene lauryl ether (surfactant) . . . 6.0 parts by weight (EMULGEN 109P, trade name, 10% aqueous solution, HLB value: 13.6, manufactured by Kao Corporation)

Comparative 1

An ink-receiving layer was formed in a manner substantially similar to that in Example 1 except that, in Example 1, a coating amount of an ink-receiving layer coating solution was changed from 150 g/m$^2$ to 133 g/m$^2$, and an in-line solution was in-line mixed by changing a velocity (coating amount) of the in-line solution from 10 g/m$^2$ to 8.9 g/m$^2$ and coated on a water-impermeable support, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

Comparative 2

A gray solid image was recorded in a manner substantially similar to that in Example 1 except that, in Example 1, the ejection conditions of a recording head during image recording were set so that an amount of ink droplets may be 5 pL (the maximum ejection amount of one dot: 11 mL/m$^2$ and a total amount of ink: 180%) and the maximum total ejection amount may be 20 mL/m$^2$. A thickness of the ink-receiving layer, the DEG absorption capacity and porosity thereof are as shown in Table 1 shown below. Furthermore, evaluations similar to those in Example 1 were performed.

Comparative 3

An ink-receiving layer was formed in a manner substantially similar to that in Example 2 except that, in Example 2, an amount of the (6) polyvinyl alcohol solution in "Composition of Ink-receiving Layer Coating Solution" was changed from 26.0 parts by weight to 56.6 parts by weight, and thereby an inkjet recording paper was obtained. A thickness of the ink-receiving layer, the DEG absorption capacity and porosity thereof are as shown in Table 1 shown below. Furthermore, evaluations similar to those in Example 1 were performed.

As shown in the Table 1, in Examples of the present invention, images where color change is suppressed, hue and color tone are excellent and stable, and blurring, brittleness and transportation trouble were suppressed from occurring were obtained.

Reference numerals used in Figures of the invention are explained below.

10: image forming apparatus; 12: drawing unit; 18: dryer unit (blower part); 24: sheet paper feeding unit (paper feeder, conditioning means); 24: sub-scanning roller; 42: suctioning and transporting unit; 44: transporting path; 52: suction fan (suctioning unit); 54: suction fan (suctioning unit); 56: suction fan (suctioning unit); 112: suction fan (suctioning unit); 130: image forming apparatus; 132: duct (conditioning means)

TABLE 1

| | Ink-Receiving Layer | | | | | | Printing | | Evaluation Result | | | | |
|---|---|---|---|---|---|---|---|---|---|---|---|---|---|
| | Thickness [mm] | Content of Silica [% by weight] | Porosity | PB Ratio | DEG Absorption Capacity [mL/m$^2$] | (×0.9) [mL/m$^2$] | Maximum Total Ejection Amount of Ink [mL/m$^2$] | Time up to Cutting | Color Change | Bleeding | Brittleness | Transportation Trouble | Color Density |
| Example 1 | 27 | 67% | 67 | 4.9 | 18 | (16.2) | 15 | 5 seconds | A | A | A | A | B |
| Example 2 | 32 | 67% | 67 | 4.9 | 21 | (18.9) | 15 | 5 seconds | A | A | B | B | A |
| Example 3 | 32 | 64% | 56 | 3.4 | 18 | (16.2) | 15 | 5 seconds | B | A | A | B | A |
| Example 4 | 26 | 69% | 69 | 6.6 | 18 | (16.2) | 15 | 5 seconds | A | A | B | A | B |
| Example 5 | 27 | 67% | 67 | 4.9 | 18 | (16.2) | 15 | 5 seconds | B | A | A | A | B |
| Example 6 | 27 | 67% | 67 | 4.9 | 18 | (16.2) | 15 | 5 seconds | B | B | A | A | B |
| Example 7 | 27 | 67% | 67 | 4.9 | 18 | (16.2) | 15 | 15 seconds | B | B | A | A | B |
| Example 8 | 28 | 67% | 67 | 4.9 | 18 | (16.2) | 15 | 5 seconds | A | A | A | A | A |
| Comparative 1 | 24 | 67% | 67 | 4.9 | 16 | (14.4) | 15 | 5 seconds | C | B | A | A | C |
| Comparative 2 | 27 | 67% | 67 | 4.9 | 18 | (16.2) | 20 | 5 seconds | D | D | A | A | B |
| Comparative 3 | 27 | 59% | 48 | 2.3 | 13 | (11.7) | 15 | 5 seconds | D | C | C | C | C |

What is claimed is:

1. An inkjet recording method for recording an image, comprising:

ejecting at least two ink compositions on an inkjet recording medium having a support and an ink-receiving layer on the support; and providing the ink-receiving layer having a porous layer that contains inorganic microparticles and a water-soluble resin;

wherein the porous layer has a porosity of at least 50%, the porosity determined by the following Equation (1):

$$\text{porosity}=\text{absorption capacity}/\text{thickness of porous layer}\times 100, \quad \text{Equation (1)}$$

wherein the absorption capacity is measured in mL/m$^2$ of diethylene glycol absorbed by the porous layer, and the thickness is measured in μm;

wherein a maximum total ejection amount of the at least two ink compositions (mL/m$^2$) is less than 90% of the absorption capacity (mL/m$^2$) of diethylene glycol, the maximum total ejection amount determined by the following Equation (2):

$$\text{maximum total ejection amount}=\text{maximum ejection amount of one dot}(\text{mL/m}^2)\times\text{total ejection amount of ink}(\%); \quad \text{Equation (2)}$$

wherein the total ejection amount of ink represents a total of actual ejection amounts (%) of the respective at least two ink compositions relative to a total of preset ejection amounts of the respective at least two ink compositions.

2. The inkjet recording method according to claim 1, wherein the absorption capacity is 20 mL/m$^2$ or less.

3. The inkjet recording method according to claim 1, wherein the inorganic microparticles comprise microparticles of a vapor-phase process silica, wherein a content of the vapor-phase process silica in the porous layer is 60% by weight or more, and wherein a content ratio of the vapor-phase process silica (p) to the water-soluble resin (b) (PB ratio by weight ratio; p/b) is within a range of from 3 to 7.

4. The inkjet recording method according to claim 1, wherein the ink compositions are ejected at a dot density of 1200 dpi or more.

5. The inkjet recording method according to claim 1, wherein the inkjet recording medium is wound in a roll, and the inkjet recording medium is cut within 10 seconds after ejection of the ink compositions.

6. The inkjet recording method according to claim 1, wherein the porous layer further includes a mordant, and wherein the mordant includes at least one compound selected from a group consisting of a water-soluble aluminum compound, a water-soluble zirconium compound and a cationic polyurethane.

7. The inkjet recording method according to claim 1, wherein the content of the water-soluble resin is from 9% to 40% by weight with respect to the total solid content of the porous layer.

8. A recorded article comprising:

an inkjet recording medium having a support and an ink-receiving layer on the support, the ink-receiving layer having a porous layer that contains inorganic microparticles and a water-soluble resin;

wherein the porous layer has a porosity of at least 50%, the porosity determined by the following Equation (1); and wherein an image is recorded by ejecting at least two ink compositions on the inkjet recording medium with a maximum total ejection amount (mL/m$^2$) represented by the following Equation (2) set at less than 90% of an absorption capacity (mL/m$^2$) of diethylene glycol in the porous layer:

$$\text{porosity}=\text{absorption capacity}/\text{thickness of porous layer}\times 100, \quad \text{Equation (1)}$$

wherein the absorption capacity is measured in mL/m$^2$ of diethylene glycol absorbed by the porous layer, and the thickness is measured in μm;

$$\text{maximum total ejection amount}=\text{maximum ejection amount of one dot}(\text{mL/m}^2)\times\text{total ejection amount of ink}(\%), \quad \text{Equation (2)}$$

wherein the total ejection amount of ink represents a total of actual ejection amounts (%) of the respective at least two ink compositions relative to a total of preset ejection amounts of the respective at least two ink compositions.

9. The recorded article according to claim 8, wherein the absorption capacity is 20 mL/m$^2$ or less.

10. The recorded article according to claim 8, wherein the inorganic microparticles comprise microparticles of a vapor-phase process silica, wherein a content of the vapor-phase process silica in the porous layer is 60% by weight or more, and wherein a content ratio of the vapor-phase process silica (p) to the water-soluble resin (b) (PB ratio by weight ratio; p/b) is within a range of from 3 to 7.

11. The recorded article according to claim 8, wherein the ink compositions are ejected at a dot density of 1200 dpi or more.

12. The recorded article according to claim 8, wherein the inkjet recording medium is wound in a roll, and the inkjet recording medium is cut within 10 seconds after ejection of the ink compositions.

13. The recorded article according to claim 8, wherein the porous layer further includes a mordant, and wherein the mordant includes at least one compound selected from a group consisting of a water-soluble aluminum compound, a water-soluble zirconium compound and a cationic polyurethane.

14. The recorded article according to claim 8, wherein the content of the water-soluble resin is from 9% to 40% by weight with respect to the total solid content of the porous layer.

* * * * *